US007511675B2

(12) United States Patent
Puente-Baliarda et al.

(10) Patent No.: US 7,511,675 B2
(45) Date of Patent: Mar. 31, 2009

(54) ANTENNA SYSTEM FOR A MOTOR VEHICLE

(75) Inventors: Carles Puente-Baliarda, Barcelona (ES); Edouard Rozan, Barcelona (ES); Jaume Anguera-Pros, Castellon (ES); Enrique Martinez-Ortigosa, Barcelona (ES)

(73) Assignee: Advanced Automotive Antennas, S.L., Barcelona (ES)

( * ) Notice: Subject to any disclaimer, the term of this patent is extended or adjusted under 35 U.S.C. 154(b) by 0 days.

(21) Appl. No.: 10/422,578

(22) Filed: Apr. 24, 2003

(65) Prior Publication Data

US 2004/0119644 A1 Jun. 24, 2004

Related U.S. Application Data

(63) Continuation-in-part of application No. PCT/EP00/10562, filed on Oct. 26, 2000.

(51) Int. Cl.
*H01Q 1/32* (2006.01)

(52) U.S. Cl. ..... 343/713

(58) Field of Classification Search ..... 343/700 MS, 343/702, 792.5, 711–713
See application file for complete search history.

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |
| 3,818,490 | A | 6/1974 | Leahy |
| 3,967,276 | A | 6/1976 | Goubau |
| 3,969,730 | A | 7/1976 | Fuchser |
| 4,024,542 | A | 5/1977 | Ikawa et al. |
| 4,131,893 | A | 12/1978 | Munson et al. |
| 4,141,016 | A | 2/1979 | Nelson |
| 4,471,358 | A | 9/1984 | Glasser |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |

(Continued)

FOREIGN PATENT DOCUMENTS

| | | |
|---|---|---|
| DE | 3337941 | 5/1985 |

(Continued)

OTHER PUBLICATIONS

Ali, M. et al., "A Triple-Band Internal Antenna for Mobile Hand-held Terminals," IEEE, pp. 32-35 (1992).

(Continued)

*Primary Examiner*—Michael C Wimer
(74) *Attorney, Agent, or Firm*—Jones Day

(57) ABSTRACT

An integrated multi-service antenna system for a motor vehicle includes a plurality of antenna structures integrated within a physical component of the motor vehicle. The plurality of antenna structures includes a radio antenna and at least one of a cellular telephony antenna and a satellite-signal antenna. The radio antenna has a radiating arm, with at least a portion of the radiating arm defining a space-filling curve, the radio antenna further has a feeding point for coupling the radio antenna to a radio receiver in the motor vehicle.

98 Claims, 23 Drawing Sheets

U.S. PATENT DOCUMENTS 4,590,614 A 5/1986 Erat
4,623,894 A 11/1986 Lee et al.
4,673,948 A 6/1987 Kuo
4,730,195 A 3/1988 Phillips et al.
4,827,271 A * 5/1989 Berneking et al. .... 343/700 MS
4,839,660 A 6/1989 Hadzoglou
4,843,468 A 6/1989 Drewery
4,847,629 A 7/1989 Shimazaki
4,849,766 A 7/1989 Inaba et al.
4,857,939 A 8/1989 Shimazaki
4,890,114 A 12/1989 Egashira
4,894,663 A 1/1990 Urbish et al.
4,907,011 A 3/1990 Kuo
4,912,481 A 3/1990 Mace et al.
4,975,711 A 12/1990 Lee
5,030,963 A 7/1991 Tadama
5,138,328 A 8/1992 Zibrik et al.
5,168,472 A 12/1992 Lockwood
5,172,084 A 12/1992 Fiedzuiszko et al.
5,200,756 A 4/1993 Feller
5,214,434 A 5/1993 Hsu
5,218,370 A 6/1993 Blaese
5,227,804 A 7/1993 Oda
5,227,808 A 7/1993 Davis
5,245,350 A 9/1993 Sroka
5,248,988 A 9/1993 Makino
5,255,002 A 10/1993 Day
5,257,032 A 10/1993 Diamond et al.
5,347,291 A 9/1994 Moore
5,355,144 A 10/1994 Walton et al.
5,355,318 A 10/1994 Dionnet et al.
5,363,114 A * 11/1994 Shoemaker ..... 343/828
5,373,300 A 12/1994 Jenness et al.
5,402,134 A 3/1995 Miller et al.
5,420,599 A 5/1995 Erkocevic
5,422,651 A 6/1995 Chang
5,451,965 A 9/1995 Matsumoto
5,451,968 A 9/1995 Emery
5,453,751 A 9/1995 Tsukamoto et al.
5,457,469 A 10/1995 Diamond et al.
5,471,224 A 11/1995 Barkeshli
5,493,702 A 2/1996 Crowley et al.
5,495,261 A 2/1996 Baker et al.
5,534,877 A 7/1996 Sorbello et al.
5,537,367 A 7/1996 Lockwood et al.
H001631 H 2/1997 Montgomery et al.
5,619,205 A 4/1997 Johnson
5,684,672 A 11/1997 Karidis et al.
5,712,640 A 1/1998 Andou et al.
5,767,811 A 6/1998 Mandai et al.
5,798,688 A 8/1998 Schofield
5,821,907 A 10/1998 Zhu et al.
5,841,403 A 11/1998 West
5,870,066 A 2/1999 Asakura et al.
5,872,546 A 2/1999 Ihara et al.
5,898,404 A 4/1999 Jou
5,903,240 A 5/1999 Kawahata et al.
5,918,183 A * 6/1999 Janky et al. ..... 455/456.1
5,926,141 A 7/1999 Lindenmeier et al.
5,943,020 A 8/1999 Liebendoerfer et al.
5,966,098 A 10/1999 Qi et al.
5,973,651 A 10/1999 Suesada et al.
5,986,610 A 11/1999 Miron
5,990,838 A 11/1999 Burns et al.
6,002,367 A 12/1999 Engblom et al.
6,011,518 A * 1/2000 Yamagishi et al. ..... 343/713
6,028,568 A 2/2000 Asakura et al.
6,031,499 A 2/2000 Dichter
6,031,505 A 2/2000 Qi et al.
6,078,294 A 6/2000 Mitarai
6,087,990 A * 7/2000 Thill et al. ..... 343/700 MS
6,091,365 A 7/2000 Derneryd et al.
6,097,345 A 8/2000 Walton
6,104,349 A 8/2000 Cohen
6,127,977 A 10/2000 Cohen
6,131,042 A 10/2000 Lee et al.
6,140,969 A 10/2000 Lindenmeier et al.
6,140,975 A 10/2000 Cohen
6,160,513 A 12/2000 Davidson et al.
6,172,618 B1 1/2001 Hakozaki et al.
6,211,824 B1 4/2001 Holden et al.
6,218,992 B1 4/2001 Sadler et al.
6,236,372 B1 5/2001 Lindenmeier et al.
6,266,023 B1 7/2001 Nagy et al.
6,281,846 B1 8/2001 Puente Baliarda et al.
6,307,511 B1 10/2001 Ying et al.
6,329,951 B1 12/2001 Wen et al.
6,329,954 B1 12/2001 Fuchs et al.
6,367,939 B1 4/2002 Carter et al.
6,407,710 B2 6/2002 Keilen et al.
6,417,810 B1 7/2002 Huels et al.
6,431,712 B1 8/2002 Turnbull
6,445,352 B1 9/2002 Cohen
6,452,549 B1 9/2002 Lo
6,452,553 B1 9/2002 Cohen
6,476,766 B1 11/2002 Cohen
6,525,691 B2 2/2003 Varadan et al.
6,552,690 B2 4/2003 Veerasamy
2002/0000940 A1 1/2002 Moren et al.
2002/0000942 A1 1/2002 Duroux
2002/0036594 A1 3/2002 Gyenes
2002/0105468 A1 8/2002 Tessier et al
2002/0109633 A1 8/2002 Ow et al.
2002/0126054 A1 9/2002 Fuerst et al.
2002/0126055 A1 9/2002 Lindenmeier et al.
2002/0175866 A1 11/2002 Gram

FOREIGN PATENT DOCUMENTS

EP 0096847 12/1983
EP 0297813 6/1988
EP 0358090 8/1989
EP 0543645 5/1993
EP 0571124 11/1993
EP 0688040 12/1995
EP 0765001 3/1997
EP 0814536 12/1997
EP 0871238 10/1998
EP 0892459 1/1999
EP 0929121 7/1999
EP 0932219 7/1999
EP 0969375 1/2000
EP 0986130 3/2000
EP 0942488 4/2000
EP 0997974 5/2000
EP 1018777 7/2000
EP 1018779 7/2000
EP 1071161 1/2001
EP 1079462 2/2001
EP 1083624 3/2001
EP 1094545 4/2001
EP 1096602 5/2001
EP 1148581 10/2001
EP 1198027 4/2002
EP 1237224 9/2002
EP 1267438 12/2002
ES 2112163 3/1998
ES 2142280 5/1998
FR 2543744 10/1984
FR 2704359 10/1994
GB 2215136 9/1989
GB 2330951 5/1999
GB 2355116 4/2001
JP 55147806 11/1980

| | | |
|---|---|---|
| JP | 5007109 | 1/1993 |
| JP | 5129816 | 5/1993 |
| JP | 5267916 | 10/1993 |
| JP | 5347507 | 12/1993 |
| JP | 6204908 | 7/1994 |
| JP | 10209744 | 8/1998 |
| KR | 200261170 | 1/2002 |
| KR | 20030014388 | 2/2003 |
| KR | 20030018333 | 3/2003 |
| WO | 9511530 | 4/1995 |
| WO | 9627219 | 9/1996 |
| WO | 9629755 | 9/1996 |
| WO | 9638881 | 12/1996 |
| WO | 9706578 | 2/1997 |
| WO | 9711507 | 3/1997 |
| WO | 9732355 | 9/1997 |
| WO | 9733338 | 9/1997 |
| WO | 9735360 | 9/1997 |
| WO | 9747054 | 12/1997 |
| WO | 9812771 | 3/1998 |
| WO | 9836469 | 8/1998 |
| WO | 9903166 | 1/1999 |
| WO | 9903167 | 1/1999 |
| WO | 9925042 | 5/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0036700 | 6/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0414252 | 6/2001 |
| WO | 0148861 | 7/2001 |
| WO | 0154225 | 7/2001 |
| WO | 0173890 | 10/2001 |
| WO | 0178192 | 10/2001 |
| WO | 0182410 | 11/2001 |
| WO | 0235646 | 5/2002 |
| WO | 02091518 | 11/2002 |
| WO | 02096166 | 11/2002 |

OTHER PUBLICATIONS

Romeu, Jordi et al., "A Three Dimensional Hilbert Antenna," IEEE, pp. 550-553 (2002).

Parker, Jordi et al., "Convoluted array elements and reduced size unit cells for frequency-selective surfaces", IEEE Proceedings H, vol. 138, No. pp. 19-22 (Feb. 1991).

Hansen, R. C., "Fundamental Limitations in Antennas," Proceedings of the IEEE, Vol. 69, No. 2, pp. 170-182 (Feb. 1981).

Jaggard, Dwight L., "Fractal Electrodynamics and Modeling," Directions in Electromagnetic Wave Modeling, pp. 435-446 (1991).

Hohlfeld, Robert G. et al., "Self-Similarity and the Geometric Requirements for Frequency Independence in Antennae," Fractals, vol. 7, No. 1, pp. 79-84 (1999).

Samavati, Hirad, et al., "Fractal Capacitors," IEEE Journal of Solid-State Circuits, vol. 33, No. 12, pp. 2035-2041 (Dec. 1998).

Pribetich, P., et al., "Quasifractal Planar Microstrip Resonators for Microwave Circuits," Microwave and Optical Technology Letters, vol. 21, No. 6, pp. 433-436 (Jun. 20, 1999).

Zhang, Dawei, et al., "Narrowband Lumped-Element Microstrip Filters Using Capacitively-Loaded Inductors," IEEE MTT-S Microwave Symposium Digest, pp. 379-382 (May 16, 1995).

Gough, C.E., et al., "High Tc coplanar resonators for microwave applications and scientific studies," Physica C, NL,North-Holland Publishing, Amsterdam, vol. 282-287, No. 2001, pp. 395-398 (Aug. 1, 1997).

Radio Engineering Reference—Book by H. Meinke and F.V. Gundlah, vol. I, Radio componebts. Circuits with lumped parameters. Transmission lines. Wave-guides. Resonators. Arrays. Radio waves propagation, States Energy Publishing House, Moscow, with English translation (1961) [4 pp].

V.A. Volgov, "Parts and Units of Radio Electronic Equipment (Design & Computation)," Energiya, Moscow, with English transalation (1967) [4 pp.].

Puente, C., et al., "Multiband properties of a fractal tree antenna generated by electrochemical deposition," Electronics Letters, IEE Stevenage, GB, vol. 32, No. 25, pp. 2298-2299 (Dec. 5, 1996).

Puente, C., et al., "Small but long Koch fractal monopole," Electronics Letters, IEE Stevenage, GB, vol. 34, No. 1, pp. 9-10 (Jan. 8, 1998).

Puente Baliarda, Carles, et al., "The Koch Monopole: A Small Fractal Antenna," IEEE Transaction on Antennas and Propagation, New York, US, vol. 48, No. 11, pp. 1773-1781 (Nov. 1, 2000).

Cohen, Nathan, "Fractal Antenna Applications in Wireless Telcommunications," Electronics Industries Forum of New England, 1997. Professional Program Proceedings Boston, MA US, May 6-8, 1997, New York, NY US, IEEE, US pp. 43-49 (May 6, 1997).

Anguera, J. et al. "Miniature Wideband Stacked Microstrip Patch Antenna Based on the Sierpinski Fractal Geometry," IEEE Antennas and Propagation Society International Symposium, 2000 Digest, Aps., vol. 3 of 4, pp. 1700-1703 (Jul. 16, 2000).

Hara Prasad, R.V., et al., "Microstrip Fractal Patch Antenna for Multi-Band Communication," Electronics Letters, IEE Stevenage, GB, vol. 36, No. 14, pp. 1179-1180 (Jul. 6, 2000).

Borja, C. et al., "High Directivity Fractal Boundary Microstrip Patch Antenna," Electronics Letters. IEE Stevenage, GB, vol. 36, No. 9, pp. 778-779 (Apr. 27, 2000).

Sanad, Mohamed, "A Compact Dual-Broadband Microstrip Antenna Having Both Stacked and Planar Parasitic Elements," IEEE Antennas and Propagation Society International Symposium 1996 Digest, Jul. 21-26, 1996, pp. 6-9.

* cited by examiner

ANTENNA SYSTEM FOR A MOTOR VEHICLE

This is a continuation-in-part of International Application Number PCT/EP00/10562, filed on Oct. 26, 2000 under the Patent Cooperation Treaty (PCT), and entitled Integrated Multiservice Car Antenna.

FIELD

The technology described in this patent application relates to the field of antennas. More particularly, the application describes an antenna system of a motor vehicle.

OBJECT

This invention relates to a multiservice antenna system that may, for example, be integrated in a plastic cover fixed in the inner surface of the transparent windshield of a motor vehicle.

The invention includes miniaturized antennas for the basic services currently required in a car, namely, the radio reception, preferably within the AM and FM or DAB bands, the cellular telephony for transmitting and receiving in the GSM 900, GSM 1800 and UMTS bands, and the GPS navigation system.

The antenna shape and design are based on combined miniaturization techniques which permit a substantial size reduction of the antenna making possible its integration into a vehicle component such as, for instance, a rearview mirror.

BACKGROUND

Until recently, the telecommunication services included in an automobile were limited to a few systems, mainly analog radio reception (AM/FM bands). The most common solution for these systems is the typical whip antenna mounted on the car roof. The current tendency in the automotive sector is to reduce the aesthetic and aerodynamic impact of such whip antennas by embedding the antenna system in the vehicle structure. Also, a major integration of the several telecommunication services into a single antenna is especially attractive to reduce the manufacturing cost or the damage due to vandalism and car wash systems.

Antenna integration is becoming more and more necessary due to a deep cultural change towards an information society. The Internet has evoked an information age in which people around the globe expect, demand, and receive information. Car drivers expect to be able to drive safely while handling e-mail and telephone calls and obtaining directions, schedules, and other information accessible on the world wide web (WWW). Telematic devices can be used to automatically notify authorities of an accident and guide rescuers to the car, track stolen vehicles, provide navigation assistance to drivers, call emergency roadside assistance, and provide remote engine diagnostics.

The inclusion of advanced telecom equipment and services in cars and other motor vehicles is very recent, and was first limited to top-level, luxury cars. However, the fast reduction in both equipment and service costs are bringing telematic products into mid-priced automobiles. The massive introduction of a wide range of such new systems would generate a proliferation of antennas upon the bodywork of the car, in contradiction with the aesthetic and aerodynamic trends, unless an integrated solution for the antennas is used.

Patent PCT/EPOO/00411 proposed a new family of small antennas based on a set of curves, referred to as space-filling curves. An antenna is said to be a small antenna (a miniature antenna) when it can fit into a small space compared to the operating wavelength. It is known that a small antenna features a large input reactance (either capacitive or inductive) that usually has to be compensated for with an external matching/loading circuit or structure. Other characteristics of a small antenna are its small radiating resistance, small bandwidth and low efficiency. Thus, it is highly challenging to pack a resonant antenna into a space that is small in terms of the wavelength at resonance. The space-filling curves introduced for the design and construction of small antennas improve the performance of other classical antennas described in the prior art (such as linear monopoles, dipoles and circular or rectangular loops).

The integration of antennas inside mirrors has been proposed. U.S. Pat. No. 4,123,756 is one of the first to propose the utilization of conducting sheets as antennas inside of mirrors. U.S. Pat. No. 5,504,478 proposed the use of the metallic sides of a mirror as an antenna for a wireless car aperture. Others configurations have been proposed to enclose a wireless car aperture, garage door opener or car alarm (U.S. Pat. No. 5,798,688) inside the mirrors of motor vehicles. Obviously, these solutions propose a specific solution for determinate systems, which generally require a very narrow bandwidth antenna, and do not offer a full integration of basic service antennas.

Other solutions were proposed to integrate the AM/FM antenna into the thermal grid of the rear windshield (Patent WO95/11530). However, this configuration requires an expensive electronic adaptation network, including RF amplifiers and filters to discriminate the radio signals from the DC source, and is not adequate for transmissions such as telephony signals because of its low antenna efficiency.

One of the substantial innovations introduced by the present invention is the use of a rearview mirror to integrate all basic services required in a car, such as radio-broadcast, GPS and wireless access to cellular networks. The main advantages of the present invention with respect to the prior art include a full antenna integration with no aesthetic or aerodynamic impact, second a full protection from accidental damage or vandalism, and a significant cost reduction.

The utilization of microstrip antennas is known in mobile telephony handsets (See, Paper by K. Virga and Y. Rahmat-Samii, "Low-Profile Enhanced-Bandwidth PIFA Antennas for Wireless Communications Packaging", published in IEEE Transactions on Microwave theory and Techniques in October 1997), especially in the configuration denoted as PIFA (Planar Inverted F Antennas). The reason for the utilization of microstrip PIFA antennas resides in their low profile, low fabrication costs, and easy integration within the hand-set structure. However, this antenna configuration has not been proposed for use in a motor vehicle. Several antenna configurations claimed by the present invention for the integration of a multiservice antenna system inside of an interior rearview mirror include the utilization of PIFA antennas.

One of the miniaturization techniques used in the present invention is based, as noted above, on space-filling curves. In a particular case of the antenna configuration proposed in this invention, the antenna shape could also be described as a multi-level structure. Multi-level techniques have already been proposed to reduce the physical dimensions of microstrip antennas (PCT/ES/00296).

SUMMARY

An antenna system for a motor vehicle includes a radio antenna integrated with a physical component of a motor vehicle. The radio antenna has a radiating arm, with at least a portion of the radiating arm defining a space-filling curve. The radio antenna also has a feeding point for coupling the radio antenna to a radio receiver in the motor vehicle.

In one embodiment, an antenna system for a motor vehicle may include a plurality of antenna structures integrated within a physical component of the motor vehicle. The plurality of antenna structures includes a radio antenna and at least one of a cellular telephony antenna and a satellite-signal antenna. The radio antenna has a radiating arm, with at least a portion of the radiating arm defining a space-filling curve. The radio antenna also has a feeding point for coupling the radio antenna to a radio receiver in the motor vehicle.

In an additional embodiment, the radio antenna in the antenna system may include a radiating arm that defines a grid dimension curve.

In another embodiment, the present invention describes an integrated multiservice antenna system for a vehicle comprising the following parts and features:

a) At least a first antenna of said antenna system includes a conducting strip or wire, said conducting strip or wire being shaped by a space-filling curve, said space-filling curve being composed by at least two-hundred connected segments, said segments forming a substantially right angle with each adjacent segment, said segment being smaller than a hundredth of the free-space operating wavelength, and said first antenna is used for AM and FM or DAB radio broadcast signal reception.

b) The antenna system can optionally include miniaturized antennas for wireless cellular services such as GSM 900 (870-960 MHz), GSM 1800 (1710-1880 MHz), UMTS (1900-2170 (MHz), CDMA 800, AMSP, CDMA 2000, KPCS, PCS, PDC-800, PDC 1.5, Bluetooth™, and others.

c) The antenna system can include a miniaturized antenna for GPS reception (1575 MHz).

d) The antenna set is integrated within a plastic or dielectric cover, said cover fixed on the inner surface of the transparent windshield of a motor vehicle.

e) The upper edges of this plastic cover are aligned with the upper, lateral or lower side of the frame of said windshield, and a conducting terminal cable is electrically connected to the metallic structure of the motor vehicle for grounding the ground conductor of the antennas within the system.

In the present invention, one of the preferred embodiments for the plastic cover enclosing the multiservice antenna system is the housing of the inside rearview mirror, including the rearview mirror support and/or the mirror itself. This position ensures an optimized antenna behavior, i.e. a good impedance matching, a substantially omnidirectional radiation pattern in the horizontal plane for covering terrestrial communication systems (like radio or cellular telephony), and a wide coverage in elevation for satellite communication systems, such as GPS.

The important size reduction of the antennas introduced in the present invention is obtained by using space-filling geometries, such as a space-filling or grid-dimension curve. A space-filling curve can be described as a curve that is large in terms of physical length but small in terms of the area in which the curve can be included. More precisely, the following definition is taken in this document for a general space-filling curve, a curve composed by at least ten segments, said segments forming an angle with each adjacent segment. Regardless of the particular design of such space-filling curve is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be placed in the same area (surface) as said space-filling curve. Additionally, to properly shape the structure of a miniature antenna according to the present invention, the segments of the space-filling curves must be shorter than a tenth of the free-space operating wavelength.

In the present invention, at least one of the antennas including a space-filling curve is characterized by a more restrictive feature: said curve is composed by at least two hundred segments, said segments forming a right angle with each adjacent segment, said segments being smaller than a hundredth of the free-space operating central wavelength. A possible antenna configuration may use said space-filling antenna as a monopole, where a conducting arm of said monopole is substantially described as a space filling curve. The antenna is then fed with a two conductor structure such as a coaxial cable, with one of the conductors connected to the lower tip of the multilevel structure and the other conductor connected to the metallic structure of the car which acts as a ground counterpoise. Of course, other antenna configurations can be used that feature a space-filling curve as the main characteristic, for example a dipole or a loop configuration. This antenna is suitable, for instance, for analog (FM/AM) or digital broadcast radio reception, depending on the final antenna size, as is apparent to anyone skilled in the art. Said antenna features a significant size reduction below 20% of the typical size of a conventional external quarter-wave whip antenna; this feature, together with the small profile of the antenna which may, for instance, be printed in a low cost dielectric substrate, allows a simple and compact integration of the antenna structure into a car component, such as inside of the rearview mirror. By properly choosing the shape of said space-filling curve, the antenna can also be used in at least certain transmission and reception application in the cellular telephone bands.

In addition to reducing the size of the antenna element covering the radio broadcast services, another important aspect of integrating the antenna system into a small package or car component is reducing the size of the radiating elements covering the wireless cellular services. This can be achieved, for instance, using a Planar Inverted F Antenna (PIFA) configuration that consists of two parallel conducting sheets, which are to connect together and are separated by either air or a dielectric, magnetic, or magneto-dielectric material. The parallel conducting are connected through a conducting strip near one of the corners and orthogonally mounted to both sheets. The antenna is fed through a coaxial cable that has its outer conductor connected to the first sheet. The second sheet is coupled either by direct contact or capacitively to the inner conductor of the coaxial cable. Although the use of PIFA antennas is known for handsets and wireless terminals, in the present invention a PIFA configuration is used advantageously for integrating a wireless service into a vehicle. The main advantage is that due to the small size, low profile and characteristic radiation pattern, the PIFA antennas are fully integrated in a preferred configuration into the housing or mounting of the inner rearview mirror, obtaining an optimum coverage for wireless networks, a null impact on the car aesthetics, and a reduced irradiation of the driver's head and body due to the protection of the mirror surface.

A further reduction of the PIFA antennas within the multiservice antenna system is optionally obtained in a preferred embodiment of the present invention by shaping at least one edge of at least one sheet of the antenna with a space-filling curve. It is known that the resonant frequency of PIFA antennas depends on its perimeter. By advantageously shaping at least a part of the perimeter of said PIFA antennas with a space-filling curve, the resonant frequency is reduced such that the antennas for wireless cellular services in said preferred embodiment are reduced as well. The size reduction that can be achieved using this combined PIFA-space-filling configuration can be better than 40% compared to a conventional, planar microstrip antenna using the same materials. The size reduction is directly related to a weight and cost reduction which is relevant for the automotive industry.

Coverage of a satellite system, such as GPS, is obtained by placing a miniature antenna close to the surface of the housing of the antenna system, which is attached to the vehicle window glass. In the present invention, the space-filling technique or the multilevel antenna technique is advantageously used to reduce the size, cost and weight of said satellite antenna. In a preferred embodiment, a microstrip patch antenna with a high dielectric permittivity substrate is used for said antenna, with at least a part of the patch shaped as either a space-filling curve or a multilevel structure.

An important advantage of the present invention is the size reduction obtained on the overall antenna systems using space-filling techniques. This size reduction allows antennas for the current applications required in today's and future vehicles (radio, mobile telephony and navigation) to be fully integrated inside of a rearview mirror. This integration supposes an important improvement of the aesthetic and visual impact of the conventional monopoles used in radio or cellular telephony reception and transmission in the automotive market.

Another important advantage of the present invention is the cost reduction, not only in the material of the antenna, but also in the manufacture and assembly of the motor vehicle. The substitution of the several conventional whip monopoles (one for each terrestrial wireless link) by the antenna system of the present invention supposes the elimination of mounting operations in production lines, such as the perforation of the car bodywork, together with the suppression of additional mechanical pieces that ensure a solid and watertight fixture of conventional whip antennas which are exposed to high air pressure. Placing the antenna system inside of the rearview mirror in the interior of the car does not require additional operations in the final assembly line. Also, a weight reduction is obtained by avoiding the conventional heavy mechanical fixtures.

According to current practice in the automotive industry, the same rearview mirror can be used through several car models or even car families; therefore, an additional advantage of the present invention is that the integrated antenna system is also standardized for such car models and families. The same component can be used irrespective of the type of vehicle, namely a standard car, a monovolume, a coupe or even a roof-less cabriolet.

DETAILED DESCRIPTION

The present invention describes an integrated multiservice antenna system for a vehicle comprising at least one miniature antenna characterized by a space-filling curve. In another embodiment, the miniature antenna may be characterized by a grid dimension curve, as described below with reference to FIGS. 26-29.

Figure 1:
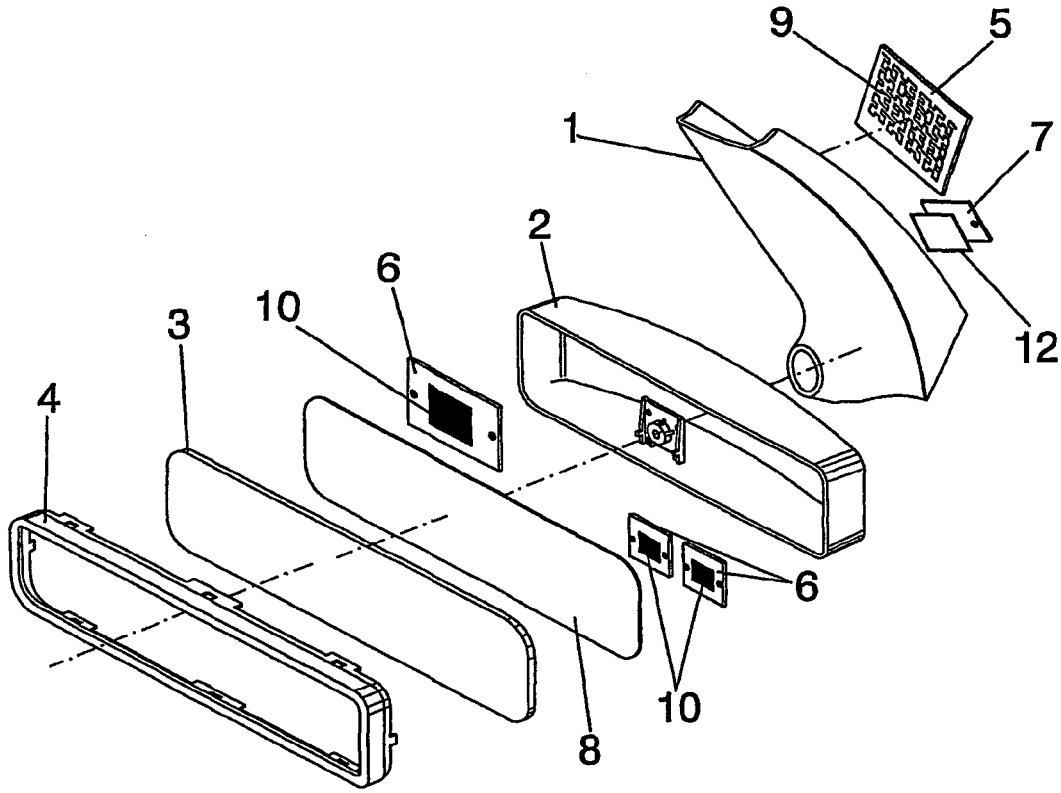
FIG. 1 represents a complete view of a preferred embodiment of the antenna system inside a rearview mirror. The rearview mirror includes a base support 1 to be fixed on the front windshield, a space-filling antenna for AM/FM reception 5, a set of miniature antennas 6 for wireless cellular system telephony transmitting or receiving GSM 900 (870-960 MHz), GSM 1800 (1710-1880 MHz) and UMTS (1900-2170 MHz) signals, and a GPS antenna 7.

FIG. 1 describes one of the preferred embodiments of the present invention. The antenna system is integrated inside of an interior rearview mirror base support 1 and inside of the rearview mirror housing 2. The system is enclosed by the mirror 3 and the mirror-frame 4. In this configuration, the mirror base support 1 is represented following a vertical extension. Such a particular mirror assembly is shown for the understanding of the invention but it does not constitute an essential part of the invention. As it is readily seen by those skilled in the art, other base support shapes can be used within the same scope and spirit of the present invention.

The antenna system comprises a space-filling antenna 5 suitable for radio broadcast signal reception, AM and FM or DAB bands, a set of miniature antennas 6 suitable for the transmission and reception of cellular telephony signals, the GSM 900, GSM 1800 and UMTS bands, and a miniature patch antenna 7 for GPS signal reception. It should be understood that, depending upon the intended market for the antenna (e.g., U.S., Japan, Europe, Korea, China, etc.), the same antenna embodiment may be adjusted for other cellular services, such as CDMA, WCDMA, AMPS, KPCS, 3G/UMTS, and others. The space-filling antenna 5 is characterized by a conducting strip 9 which defines a space-filling curve. This space-filling curve is composed by at least two-hundred segments, with said segments forming a right angle with each adjacent segment, and said segments being smaller than a hundredth of the free-space operating central wavelength. The conducting strip 9 can be supported by any class of low loss dielectric material, including flexible or transparent boards.

In this embodiment, one arm of the conducting strip is connected to a first conductor of a two-conductor transmission line, and the second conductor is connected to the metallic structure of the vehicle, which acts as a metallic counterpoise. Although the space-filling shape of the antenna and its use for receiving radio broadcast is part of the essence of the invention, it is apparent to those skilled in the art that the length of the space-filling curve can be scaled using conventional techniques to obtain an optimal matching impedance in the VHF band. Depending on the chosen scale, said antenna can be made appropriate for either FM/AM or DAB/AM reception.

Compared to the typical length of an external quarter-wavelength monopole, the size of said space-filling antenna is reduced at least by a factor of five, that is, the final size is smaller than 20% of a conventional antenna. Fed as a monopole, this antenna observes a similar radiation pattern to a conventional elemental monopole, i.e. a fairly omnidirectional monopole in a direction perpendicular to the antenna. The position inside of the mirror base support 1 offers a wide open area, assuring correct reception from all directions. Like other reception systems, the signal quality can be improved using diversity techniques based on space diversity (using several similar antennas for receiving the same signal) or polarization diversity (exciting orthogonal current modes within the same antenna structure).

Together with the space-filling antenna 5, this example of a preferred embodiment of the multiservice antenna system comprises a miniature cellular telephony antenna subsystem for transmitting and receiving cellular telephony signals, such as GSM 900, GSM 1800, UMTS, and other cellular bands. The antennas 6 are characterized by a first planar conducting sheet 10, with said sheet being smaller than a quarter of the operating wavelength, and a second parallel conducting sheet 8 that acts as a ground counterpoise. In the present embodiment, the antennas share the same ground counterpoise 8, with the ground counterpoise being juxtaposed or close to the mirror 3. Both the conducting sheet 10 and the ground counterpoise 8 are connected through a conducting strip. The conducting sheet 10 is fed by means of a vertical conducting pin coupled either by direct ohmic contact or by capacitive coupling. The antenna polarization is mainly vertical, allowing a good penetration of the signal inside the car.

The antennas are optionally combined by means of a diplexer or triplexer filter with a single transmission line connected to the input of said diplexer or triplexer. Said diplexer or triplexer can be realized using concentrated elements or stubs, but in any case is supported by the same ground counterpoise 8. Moreover, additional electronic circuits can be included, on the same circuit board, such as an electrochromic system or a rain detector. The radiation pattern of the antenna 6 is similar to those of a conventional patch antenna, assuring a fairly omnidirectional pattern in the horizontal plane. However, the position of the antennas 6 with respect to the front windshield and the ground counterpoise 8 juxtaposed to the mirror 3 limits the power radiated inside the car, especially in the direction of the head of the driver, and reduces any possible interaction or biological effect with the human body along with interference from other electronic devices.

The antenna system is completed by a satellite antenna such as a GPS antenna 7. Said GPS antenna 7 consists of two parallel conducting sheets (spaced by a high permittivity dielectric material) forming a microstrip antenna with circular polarization. The circular polarization can be obtained either by a two-feeder scheme or by perturbing the perimeter of the superior conducting sheet 11 of the antenna. The GPS antenna 7 also includes a low-noise high-gain pre-amplifier 12. This amplifier is included on a chip such as for instance those proposed by Agilent or Mini-Circuits (series HP58509A or HP58509F for instance). The chip is mounted on a microstrip circuit alongside by side with the microstrip GPS antenna such that both the antenna and the circuit share the same conducting ground plane. A major difference between the GPS system and the radio or the cellular telephony is that a GPS antenna requires a wide open radiation pattern in the vertical direction. An adequate position for this antenna is within the mirror base support 1 in a substantially horizontal position. Even though the antenna position presents a slight inclination with respect to the horizontal, the radiation pattern of such microstrip antenna is sufficiently omnidirectional to assure a good reception from multiple satellite signals over a wide range of positions.

As is clear to those skilled in the art, the novelty of the antenna system invention is based, in part, on choosing a very small, low cost, flat space-filling antenna for radio reception, in combining said space-filling antenna with other miniature antennas for wireless cellular services and satellite services, and packaging them all inside a small plastic or dielectric housing attached on a glass window. In this particular embodiment, the inside rearview mirror is chosen advantageously as a housing for the whole antenna system because of its privileged position in the car (wide open visibility for transmitting and receiving signals, close position to the control panel of the car) and insignificant visual impact on the car design; nevertheless it is apparent to those skilled in the art that the same basic antenna system can be integrated in other car components, such as a rear brake-light, without affecting the essential novelty of the invention.

Figure 2:
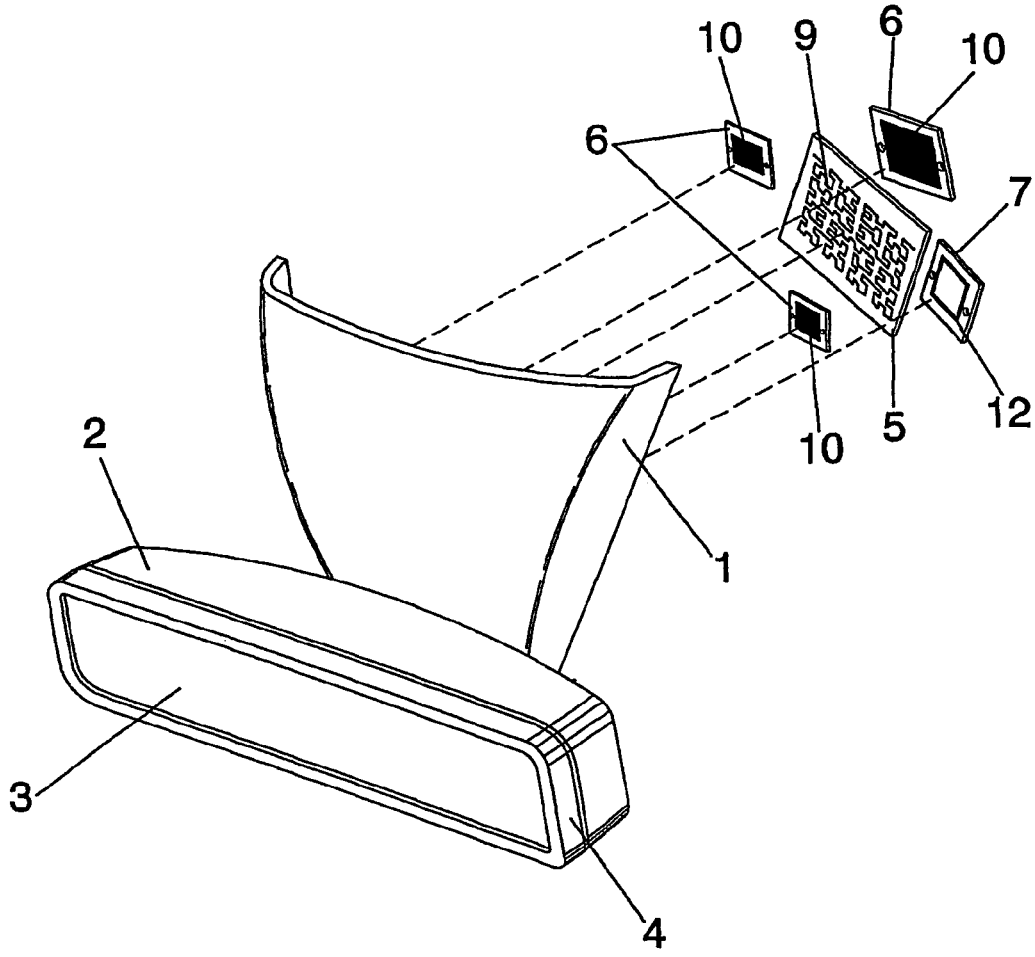
FIG. 2 shows another preferred embodiment of the present invention. The rearview mirror base support 1 to be fixed on the front windshield includes a space-filling antenna for AM/FM reception 5, a set of miniature antennas 6 for wireless cellular system telephony transmitting or receiving GSM 900 (870-960 MHz), GSM 1800 (1710-1880 MHz) and UMTS (1900-2170 MHz) signals, and a GPS antenna 7.

Presented in FIG. 2 is another similar configuration that can be used within the scope of the present invention. This configuration may include, for instance: placing the wireless cellular antennas 6 inside the support of the mirror structure 1 around the main radio broadcast space-filling antenna 9; integrating two of the wireless cellular services into a standard dual-band antenna and placing it either inside the mirror housing 2 or mirror support 1; removing at least one of the antenna components for the antenna system in case one or more of the services is not required for a particular car model or car family; or redesigning a circularly polarized satellite antenna 7 for other frequencies and satellite applications that GPS (such as for instance Iridium, GlobalStar or other satellite phone or wireless data services) using conventional scaling techniques.

Figure 3:
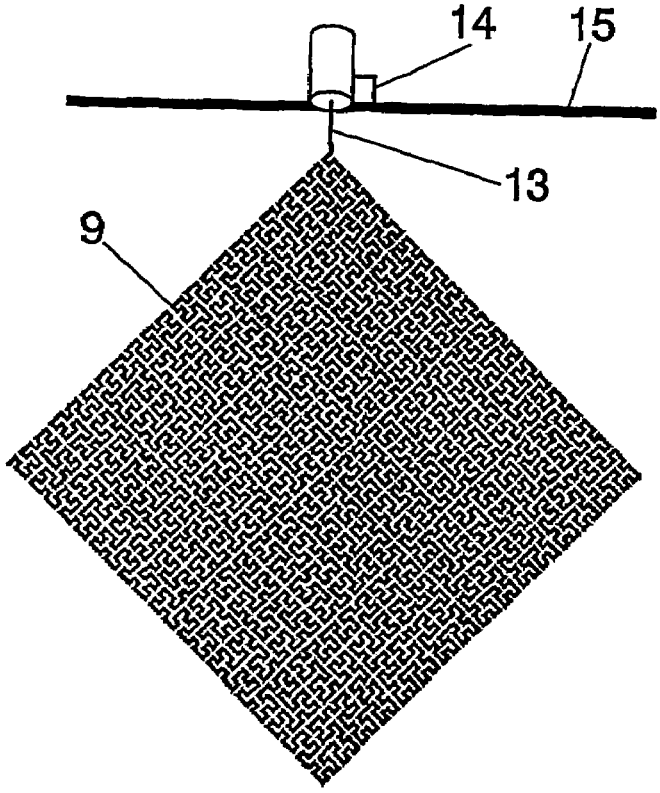
FIG. 3 shows a space-filling structure antenna for reception of AM/FM bands. The antenna is fed as a monopole and is placed inside a rearview mirror support. The antenna can be easily adapted for a DAB system by scaling it proportionally to the wavelength reduction.

FIG. 3 describes a preferred embodiment of the space-filling antenna 5 used for AM/FM signal reception. In this case, the conducting strip 9 defines a space-filling curve according to the definition in the present invention. The conducting strip 9 can, for instance, be printed using standard techniques on a low cost thin dielectric material such as glass fiber or polyester, which acts as a support for the antenna. In a preferred embodiment, this configuration is fed with a two conductor structure, such as a coaxial cable, with one of the conductors 13 connected to the conducting strip 9 of the space-filling antenna and the other conductor 14 connected to the metallic structure of the car 15, acting as ground counterpoise. The other side of the conducting strip 9 can be left without any connection, or can be connected to a specific load or to the same vehicle structure 15 to modify its impedance matching features, while keeping the same essential space-filling structure. The antenna is placed in the rearview mirror support 1 parallel to the windshield to assure an orientation close to vertical. Since this antenna is small compared to the operating wavelength, the radiation pattern observes a maximum radiation in the plane perpendicular to the antenna orientation, the horizontal plane in this case, which yields an optimum coverage for receiving terrestrial radio broadcast signals.

Figure 4:
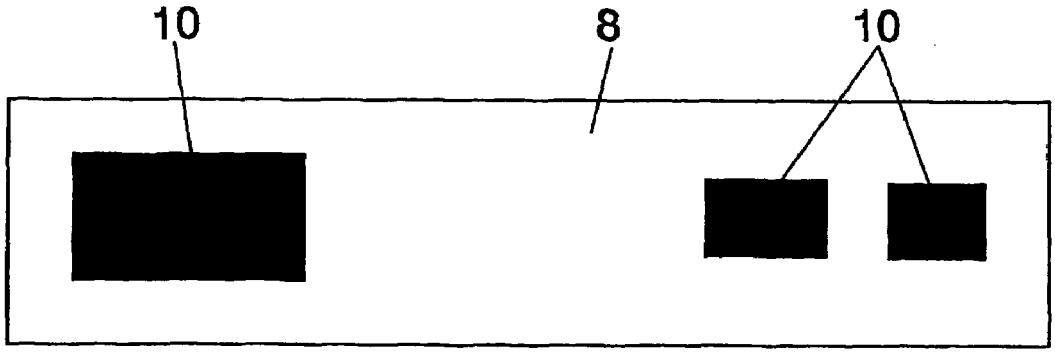
FIG. 4 shows an example set of miniature antennas 6 for a cellular telephony system for transmitting GSM 900 (870-960 MHz), GSM 1800 (1710-1880 MHz) and UMTS (1900-2170 MHz). In this configuration, the antennas are composed of two planar conducting sheets, the first one being shorter than a quarter of the operation wavelength 10, and the second one being the ground counterpoise 8. In this case, a separate conducting sheet 10 is used for the three mobile systems whereas the counterpoise is common to each of the three antennas. Both the conducting sheet 10 and the counterpoise are connected through a conducting strip. Each conducting sheet 10 is fed by a separate pin.

FIG. 4 describes another preferred embodiment where the set of miniature antennas for cellular signals, such as GSM 900, GSM 1800, UMTS and other equivalent systems, are distributed onto a common conducting ground counterpoise 8. The size and shape of the conducting sheet 10 is designed using standard well-known techniques to ensure a good impedance matching within the desired band. Each conducting sheet 10 presents a dimension lower than a quarter-wavelength of the operational frequency. This notable size reduction is due to the presence of a conducting strip between the conducting sheet 10 and the ground counterpoise 8. This configuration is fed by means of a vertical conducting pin coupled either by direct ohmic contact or by capacitive coupling to the conducting sheet 10. The radiation pattern of such antenna is similar to the radiation pattern of a conventional patch antenna presenting a major wide open lobe in the direction perpendicular to the conducting sheet 10, the horizontal plane in this case. Also, due to the reduced dimensions of the ground plane 8, radiation occurs in the opposite direction, assuring a fairly omnidirectional pattern. It is clear to those skilled in the art, that the relative position of the antenna is not important and can be changed without affecting the essence of the present invention.

Figure 5:
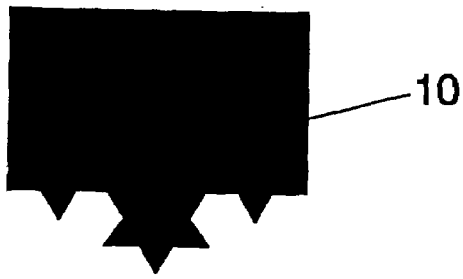
FIG. 5 provides an example of a space-filling perimeter of the conducting sheet 10 to achieve an optimized miniaturization of the mobile telephony antenna 6.

Presented in FIG. 5 is an improvement of any of the preceding embodiments that can be obtained by shaping at least a part of the perimeter of said conducting sheet 10 with a space-filling curve. As the resonant frequency of such a configuration depends on the total length of the perimeter, the improvement of the perimeter length using a space-filling perimeter reduces the total size of the conducting sheet 10. Other space-filling curves besides the one displayed in FIG. 5 can be used to increase the perimeter length within the same scope and spirit of the present invention. An important advantage of using a space-filling perimeter is that the resonant frequency is changed, while the rest of the antenna parameters (such as the radiation pattern or the antenna gain) are kept practically the same, which allows a size reduction (together with a cost and weight reduction) with respect to the previous embodiment.

Figure 6:
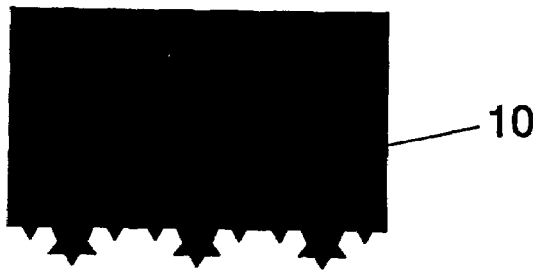
FIG. 6 shows another example of a space-filling perimeter of the conducting sheet 10 to achieve an optimized miniaturization of the mobile telephony antenna 6.

As mentioned above, other space-filling curves can be used within the spirit of the present invention, as shown in FIG. 6.

In FIGS. 7 to 10 presents several preferred embodiments for a further miniaturization of the satellite antenna 7. In this case, the perimeter of the patch which characterizes the microstrip antenna is advantageously shaped by a space-filling curve.

Figure 7:
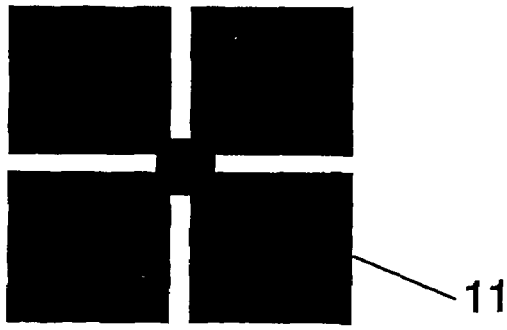
FIG. 7 shows an example of miniaturization of the satellite GPS patch antenna using a space-filling or multilevel antenna technique. The GPS antenna is formed by two parallel conducting sheets spaced by a high permittivity dielectric material, forming a microstrip antenna with circular polarization. The circular polarization is obtained either by means of a two-feeder scheme or by perturbing the perimeter of the patch. The superior conducting sheet 11 perimeter is increased by confining it in a space-filling curve.

FIG. 7 presents a preferred embodiment for a GPS antenna, characterized by its space-filling perimeter constructed with 20 segments. The shape can also be seen as a multilevel structure formed by 5 coupled squares. Except for the conducting sheet 11 shaping the patch, the antenna design remains similar to a conventional patch rectangular antenna. The circular polarization can be obtained either by a two-feeder scheme or by perturbing the perimeter of the superior conducting sheet 11 of the antenna, using the same conventional technique as a rectangular conducting sheet 11. The antenna also includes a low-noise high-gain pre-amplifier 12, mounted on a microstrip circuit alongside a microstrip GPS antenna, such that both the antenna and the circuit share the same conducting ground plane. The antenna is placed in the mirror base support 1 in a substantially horizontal position to ensure a broad, almost hemispherical coverage for the multiple satellite link.

Figure 8:
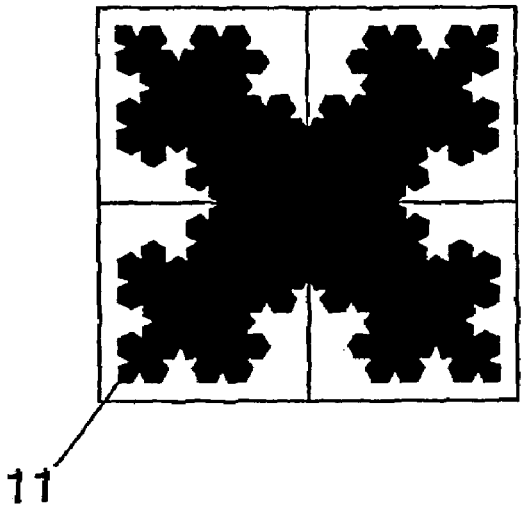
FIG. 8 illustrates another example of the miniaturization of a GPS patch antenna, where the superior conducting sheet 11 perimeter is a space-filling curve.

Another preferred embodiment is presented in FIG. 8. In this case, a similar space filling scheme as the one applied in the preceding embodiment is used at the corners of each of the four squares. The size reduction of such antenna is beyond 59%, decreasing the antenna cost due to the area reduction of the high permittivity dielectric material supporting the microstrip antenna configuration. The radiation pattern of such antenna is kept in the same basic shape as a conventional microstrip antenna, ensuring an almost hemispherical coverage in the upper semi-space.

Figure 9:
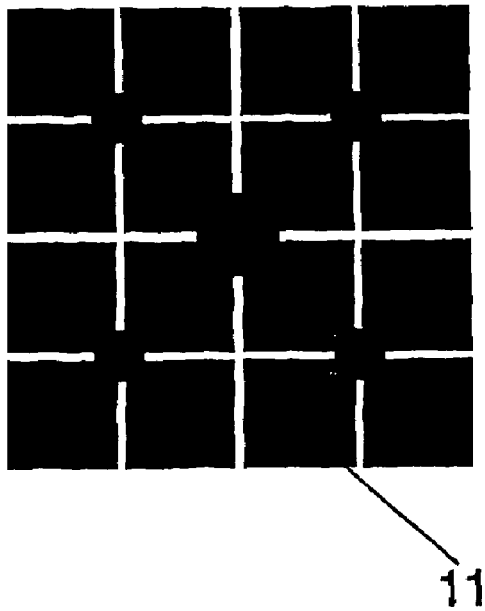
FIG. 9 shows another example of the miniaturization of a GPS patch antenna, where the superior conducting sheet 11 perimeter is a space-filling curve.
Figure 10:
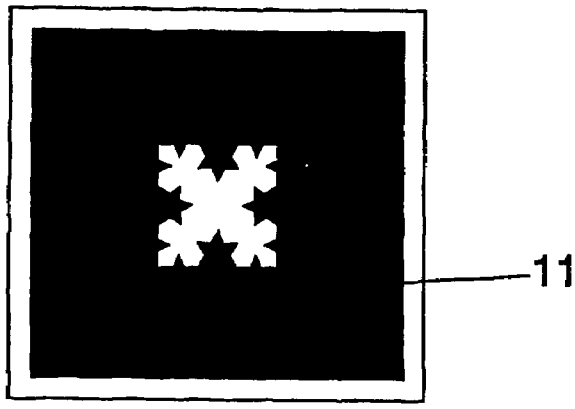
FIG. 10 illustrates another example of the miniaturization of a GPS patch antenna where the perimeter of the inner gap of the superior conducting sheet 11 is a space-filling curve.

In FIGS. 9 and 10, other space-filling curves are used to shape the perimeter of the conducting sheet 11 of the satellite antenna. It will be apparent to those skilled in the art that similar techniques to those described above can also be applied to the wireless cellular antennas within the scope of the present invention.

In FIG. 9, the external perimeter is conformed by another space-filling curve. In FIG. 10, an aperture is realized in the center of the conducting sheet 11. The length of said aperture is increased by a space-filling curve following a similar pattern as the one in FIG. 9. In both cases, the antenna size is reduced, maintaining the circular polarization and the radiation pattern.

Figure 11:
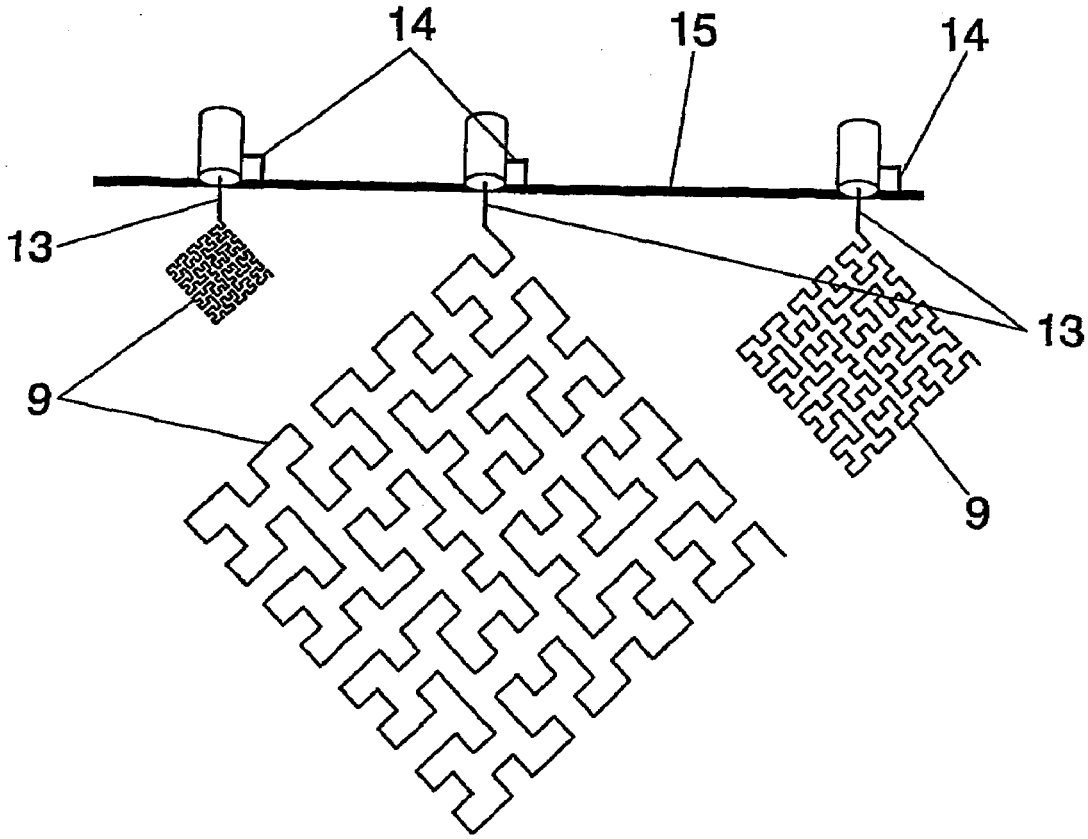
FIG. 11 presents another preferred embodiment, wherein at least two space-filling antennas are supported by the same surface: one space-filling antenna for receiving radio broadcast signals, preferable within the AM and FM or DAB bands; and the other space-filling antennas for transmitting and receiving in the cellular telephony bands, such as the GSM band. All of the space-filling antennas are connected at one end to one of the wires of a two-conductor transmission line, such as a coaxial cable, with the other conductor of the transmission line connected to the metallic car structure.

In FIG. 11, another preferred embodiment is presented. The antenna system is placed in a substantial vertical position inside the mirror support 1, or parallel to the glass window to minimize the thickness of said support 1. In this preferred embodiment, one space-filling antenna is characterized by a conducting strip 9 composed by at least two-hundred segments. Said segments form a substantially right angle with each adjacent segment, and are smaller than a hundredth of the free-space operating central wavelength. This antenna is suitable for radio broadcast signal reception, such as AM and FM or DAB bands. The conducting strip 9 can be supported by any class of low loss dielectric materials including flexible or transparent boards. The system is completed by other space-filling antennas, with a conducting strip 9 that also defining a space-filling curve, although the number of segments is made smaller with respect to the previous one. These other space-filling antennas are designed transmission and reception using GSM 900, GSM 1800, UMTS or other equivalent cellular systems. In this embodiment, a first conductor of a two-conductor input transmission line is connected to each conducting strip 9, while the second conductor is connected to the conducting structure of the vehicle, said conducting structure acting as the metallic counterpoise of the monopole configuration. Being very small compared to the wavelength, these antennas observe a similar radiation pattern to that of a conventional elemental monopole, i.e. a substantially omnidirectional pattern on the horizontal plane. The position inside the mirror base support 1 offers an advantageous wide open visibility, assuring a correct reception from virtually any azimuthal direction. It is clear to those skilled in the art that the same innovative space-filling shapes disclosed in the present invention can be advantageously used in any diversity techniques (such as space of polarization diversity) in order to compensate for signal fading due to a multipath propagation environment. The small size of said space-filling antennas allows an easy integration of the antenna in multiple parts of the motor vehicle, for instance, the rear brake-light housing mounted upon the rear window, or the dark sun-protection band that frames windows in a broad range of car models. Any of these configurations are compatible with the preferred embodiments shown in the present invention and share with them the same essential innovative aspect.

Figure 12:
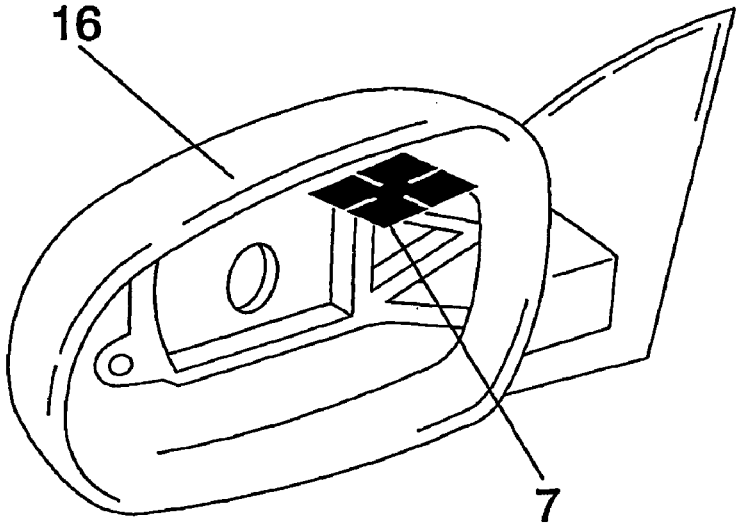
FIG. 12 presents an alternative position for a GPS antenna 7. The antenna is placed in a horizontal position, inside the external housing 16 of an external rearview mirror.

An alternative position for a GPS antenna 7 is presented in FIG. 12. The important size reduction achieved by confining the perimeter of the conducting sheet 11 in a space-filling curve allows alternative positions to that presented in FIG. 1. In FIG. 12, the GPS antenna 7 is placed in an external rear-view mirror housing 16, in a substantially horizontal position. Placed in the top part of the housing 16, no obstacle blocks the vertical visibility of the antenna. The presence of metallic pieces of the car bodywork near the antenna does not affect the good reception of GPS signals, even if some signals are reflected. The right circular polarization of the GPS antenna cancels all other signals received at the same frequency with different polarizations. In particular, reflected satellite signals suffer from a strong polarization change and therefore do not interfere with the circularly polarized directly incoming signals. Together with the antenna, a low-noise amplifier is optionally mounted on the microstrip circuit alongside the microstrip GPS antenna such that both the antenna and the circuit share the same conducting ground plane.

Figure 13:
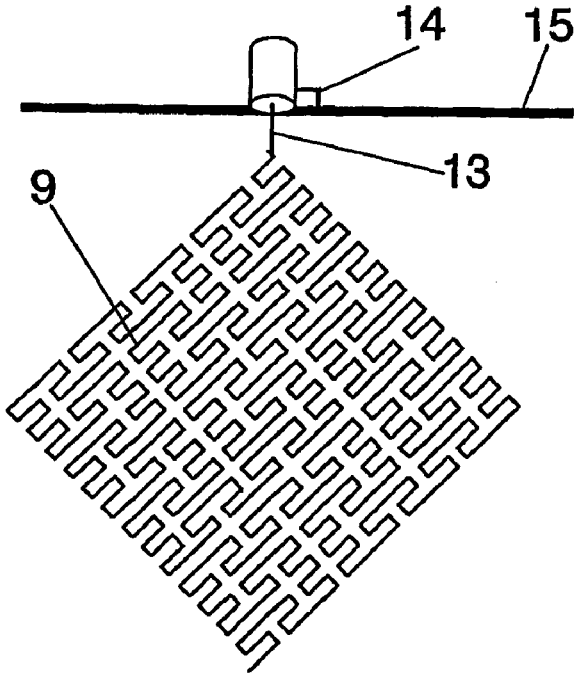
FIG. 13 illustrates another example of a space-filling antenna, based on an SZ curve, for AM/FM reception. The antenna is fed as a monopole and is placed inside a rearview mirror support.

FIG. 13 describes another preferred embodiment used for AM/FM reception. In this case, the conducting strip 9 describes another space-filling curve according to the definition in the present invention. This configuration is also fed with a two conductor structure, such as a coaxial cable, with one of the conductors 13 connected to the conducting strip 13 of the space-filling antenna and the other conductor 14 connected to the metallic structure of the car 15 and acting as a ground counterpoise. The other side of the conducting strip 9 can be left without any connection or can be connected to a specific load or to the same vehicle structure 15 to modify its impedance matching features, yet keeping the same essential space-filling structure as the core of the invention. The antenna is placed in the rearview mirror support 1 parallel to the windshield to assure an orientation close to vertical. Since this antenna is small compared to the operating wavelength, the radiation pattern observes a maximum radiation in the plane perpendicular to the antenna orientation, in the horizontal plane in this case, which yields an optimum coverage for receiving terrestrial radio broadcast signals.

FIGS. 14-24 illustrate several alternative space-filling antenna structures for use in an antenna system for a motor vehicle. Each of the antenna structures illustrated in FIGS. 14-24 may, for example, be substituted for any of the space-filling antennas 5, 9, described above. In addition, each of the antenna structures illustrated in FIGS. 14-24 may alternatively be supported by a dielectric substrate(s), similar to the space-filling antenna 5 described above with reference to FIG. 1.

Figure 14:
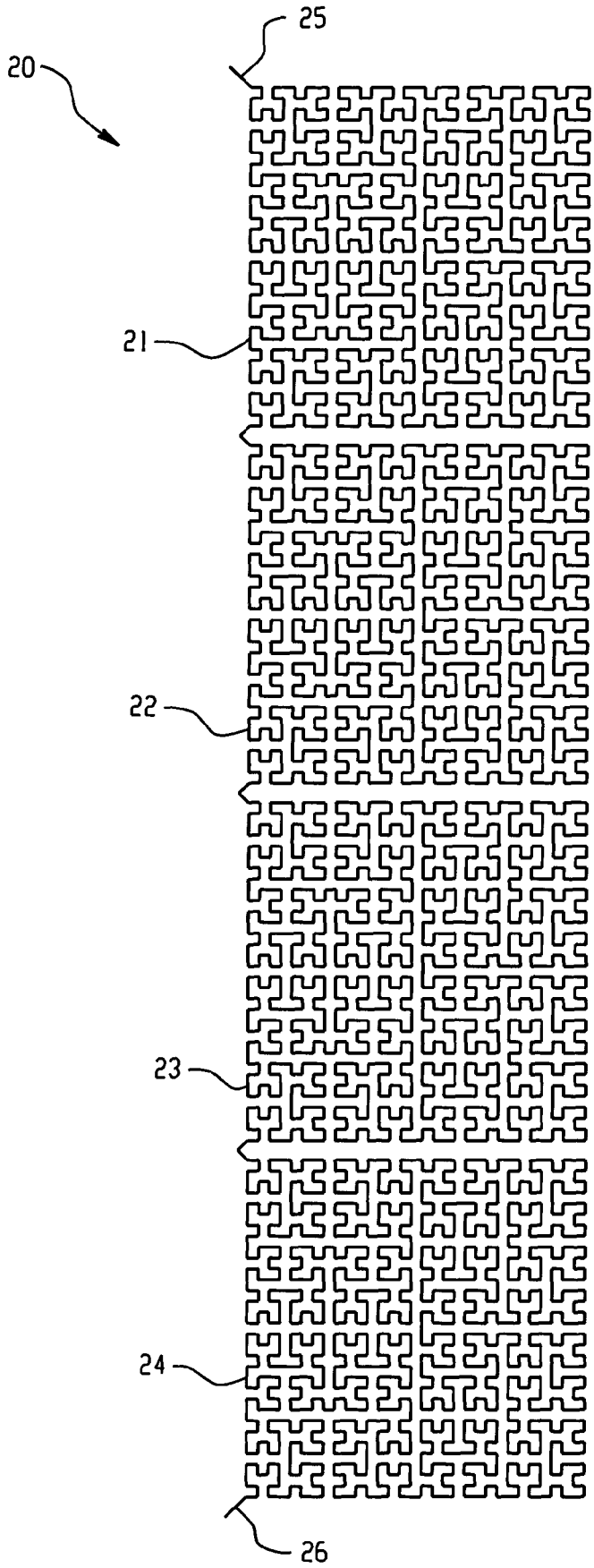
FIG. 14 illustrates a cascaded space-filling antenna structure for use in an antenna system for a motor vehicle.

FIG. 14 illustrates a cascaded space-filling antenna structure 20 for use in an antenna system for a motor vehicle. The space-filling antenna 20 includes four cascaded sections 21, 22, 23, 24 that each define a space-filling curve, and that collectively define a rectangular-shaped radiating arm. More specifically, each of the four cascaded sections 21, 22, 23, 24 of the space-filling antenna 20 include a conductor that extends in a continuous space-filling curve. The four sections 21, 22, 23, 24 are cascaded together, forming a continuous conductive path from a first antenna endpoint 25 to a second antenna endpoint 26. The first antenna endpoint 25 may, for example, function as a feeding point for the antenna 20, and the second antenna endpoint 26 may, for example, function as a grounding point for the antenna 20.

Figure 15:
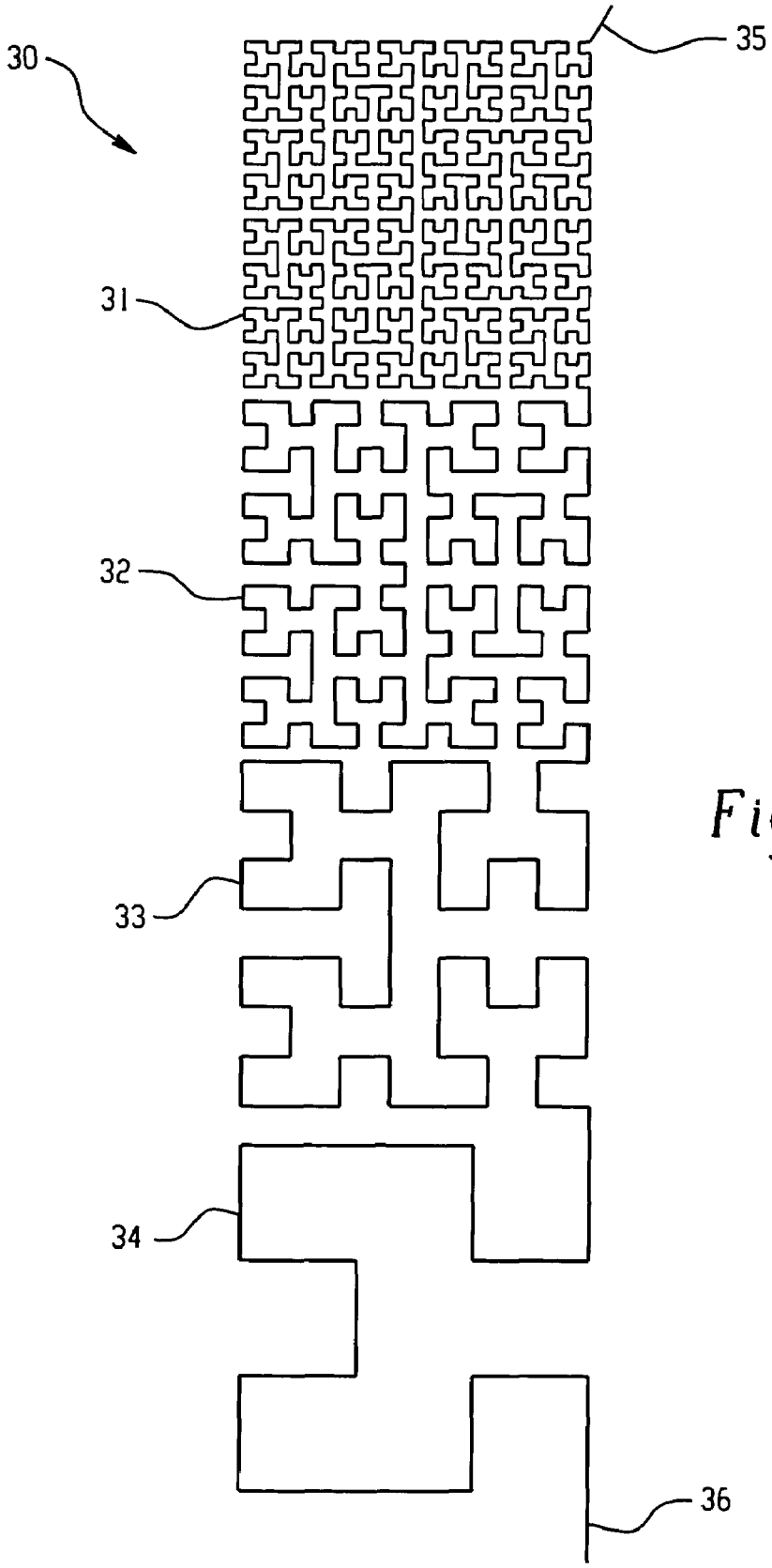
FIG. 15 illustrates one alternative cascaded space-filling antenna structure for use in an antenna system for a motor vehicle.

FIG. 15 illustrates one alternative cascaded space-filling antenna structure 30 for use in an antenna system for a motor vehicle. This embodiment 30 is similar to the cascaded antenna structure 20 of FIG. 14, except that each cascaded section 31, 32, 33, 34 defines a space-filling curve of a different length and having a different number of segments. Similar to the antenna 20 of FIG. 14, the four sections 31, 32, 33, 34 of this antenna structure 30 are cascaded together, forming a continuous conductive path from a first antenna endpoint 35 to a second antenna endpoint 36. The first antenna endpoint 35 may, for example, function as a feeding point for the antenna 30, and the second antenna endpoint 36 may, for example, function as a grounding point for the antenna 30.

Figure 16:
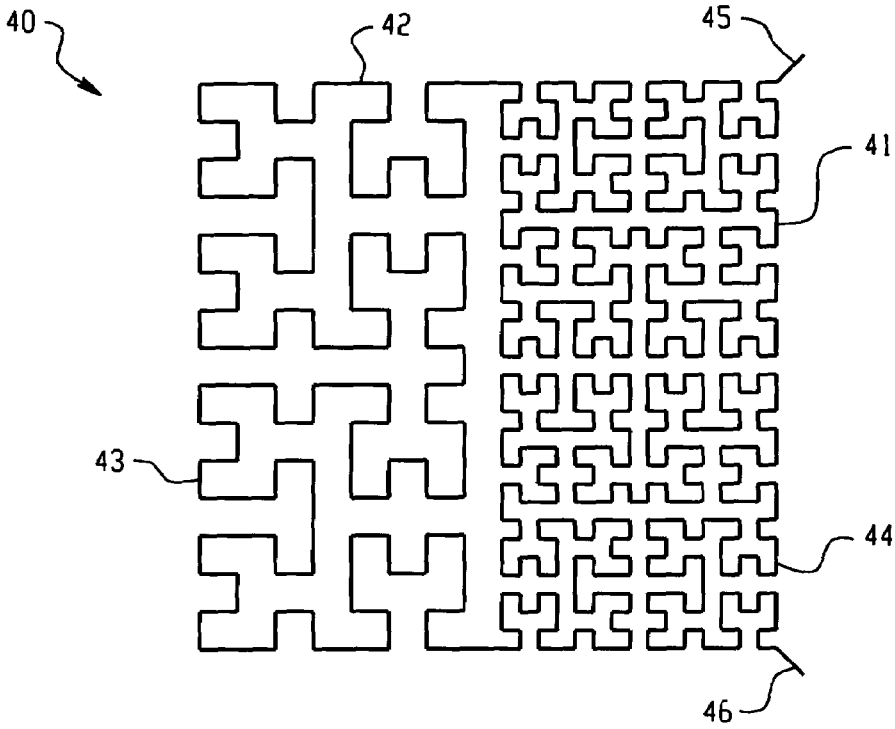
FIG. 16 illustrates another alternative cascaded space-filling antenna structure for use in an antenna system for a motor vehicle.

FIG. 16 illustrates another alternative cascaded space-filling antenna structure 40 for use in an antenna system for a motor vehicle. The space-filling antenna 40 includes four cascaded sections 41, 42, 43, 44 that each define a space-filling curve, and that collectively define a square-shaped radiating arm. More specifically, each of the four cascaded sections 41, 42, 43, 44 include a conductor that extends in a continuous space-filling curve. The two cascaded sections 41, 44 illustrated on the right half of the antenna structure each define a space-filling curve having a first length and a first number of segments, and the two cascaded sections 42, 43 illustrated on the left half of the antenna structure each define a space-filling curve having a second length and a second number of segments. In addition, the four sections 41, 42, 43, 44 are cascaded together at their endpoints, forming a continuous conductive path from a first antenna endpoint 45 to a second antenna endpoint 46. The first antenna endpoint 45 may, for example, function as a feeding point for the antenna 40, and the second antenna endpoint 46 may, for example, function as a grounding point for the antenna 40.

Figure 17:
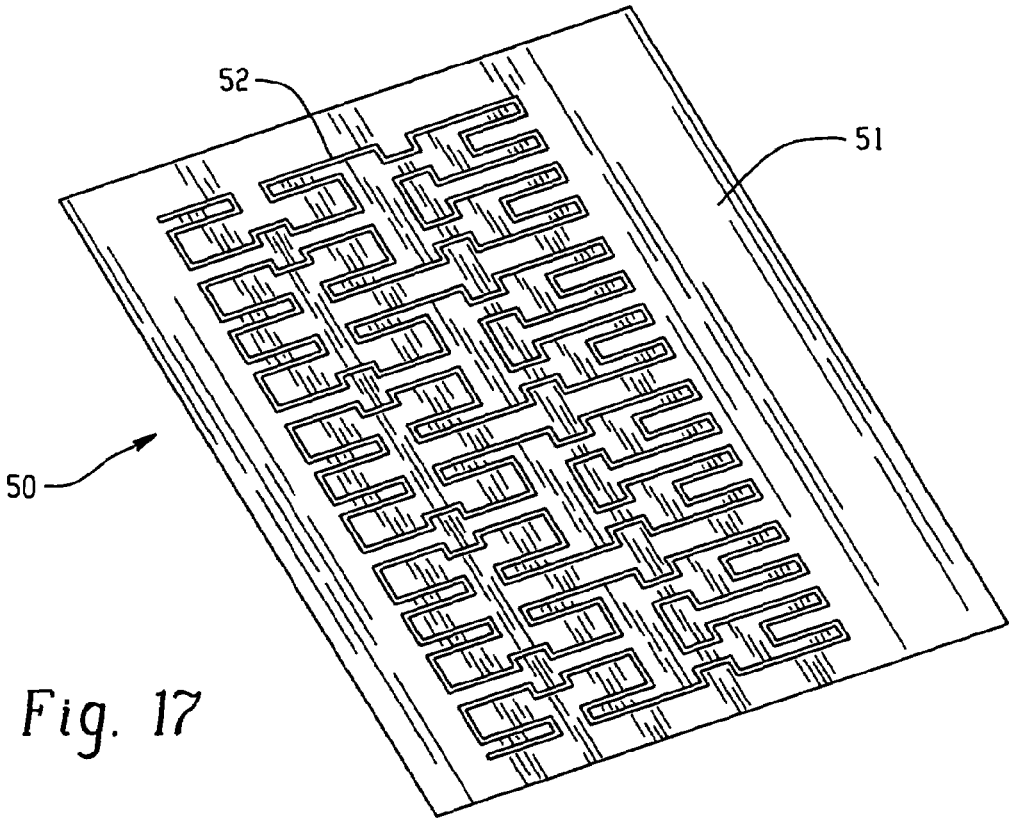
FIG. 17 illustrates a space-filling slot antenna for use in an antenna system for a motor vehicle.

FIG. 17 illustrates a space-filling slot antenna 50 for use in an antenna system for a motor vehicle. This antenna embodiment 50 includes a conductive plate 51 and a space-filling curve 52 that is defined by a slot through the surface of the conductive plate 51. The antenna 50 may, for example, include an antenna feeding point on the surface of the conductive plate 51.

Figure 18:
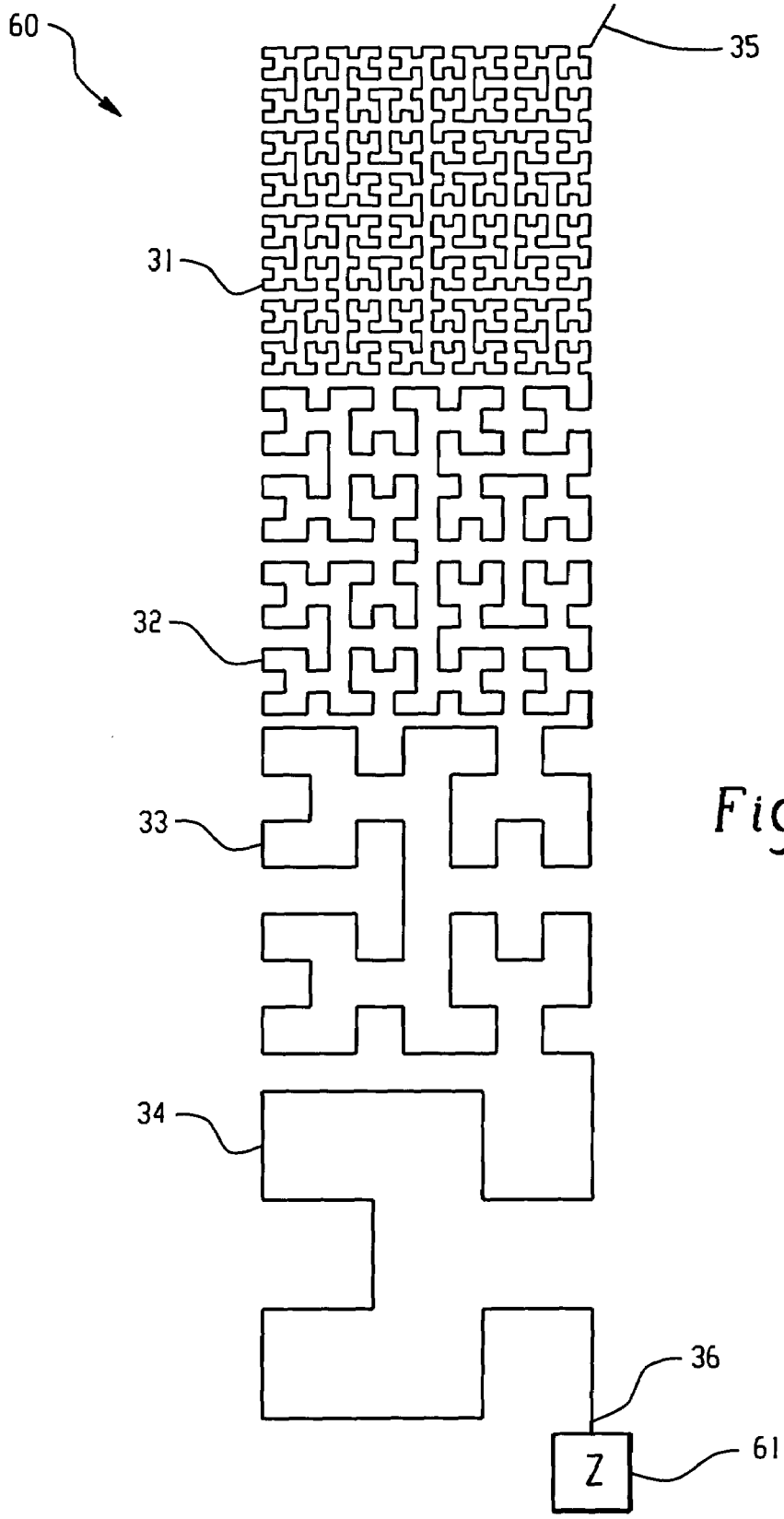
FIG. 18 illustrates a cascaded space-filling antenna structure having a reactive load (z).

FIG. 18 illustrates a cascaded space-filling antenna structure 60 having a reactive element (z) 61 coupled in series with the antenna feeding point 36. This antenna embodiment 60 is similar to the cascaded antenna 30 of FIG. 15, with the exception of the reactive element 61. The reactive element 61 is preferably an inductor, and may be selected to tune the impedance of the antenna 60.

Figure 19:
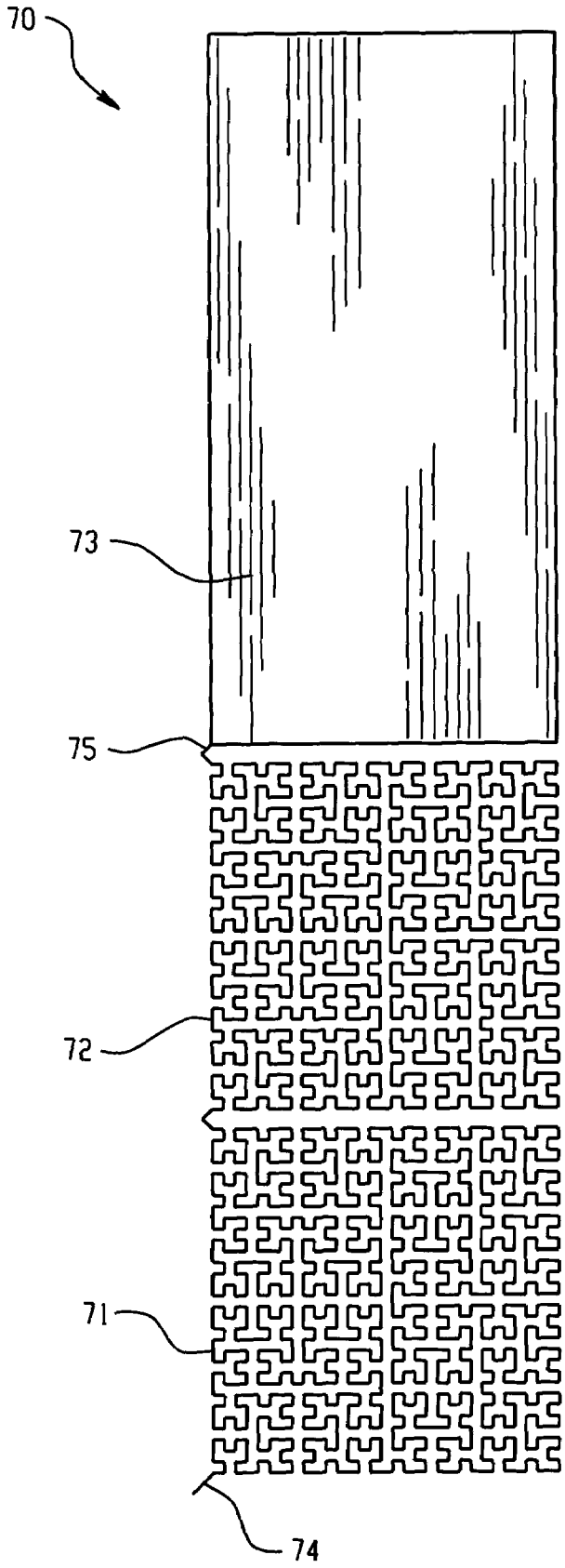
FIG. 19 illustrates a cascaded space-filling antenna structure having a top-loading element.

FIG. 19 illustrates a cascaded space-filling antenna structure 70 having a top-loading element 73. This embodiment 70 is similar to the cascaded antenna 20 of FIG. 14, except that two of the cascaded sections are replaced by the top-loading element 73. The space-filling antenna 70 includes two cascaded sections 71, 72 and the top-loading element 73. Both of the cascaded sections 71, 72 include a conductor that defines a space-filling curve. More particularly, the two cascaded sections 71, 72 are cascaded together, forming a continuous conductive path from a first endpoint 74 to a second endpoint 75. The second endpoint 75 is coupled to the top-loading element 73, which is a rectangular-shaped conductive plate. The first endpoint 74 may, for example, function as a feeding point for the antenna 70. The top-loading portion 73 may, for example, include a grounding point for the antenna 70.

Figure 20:
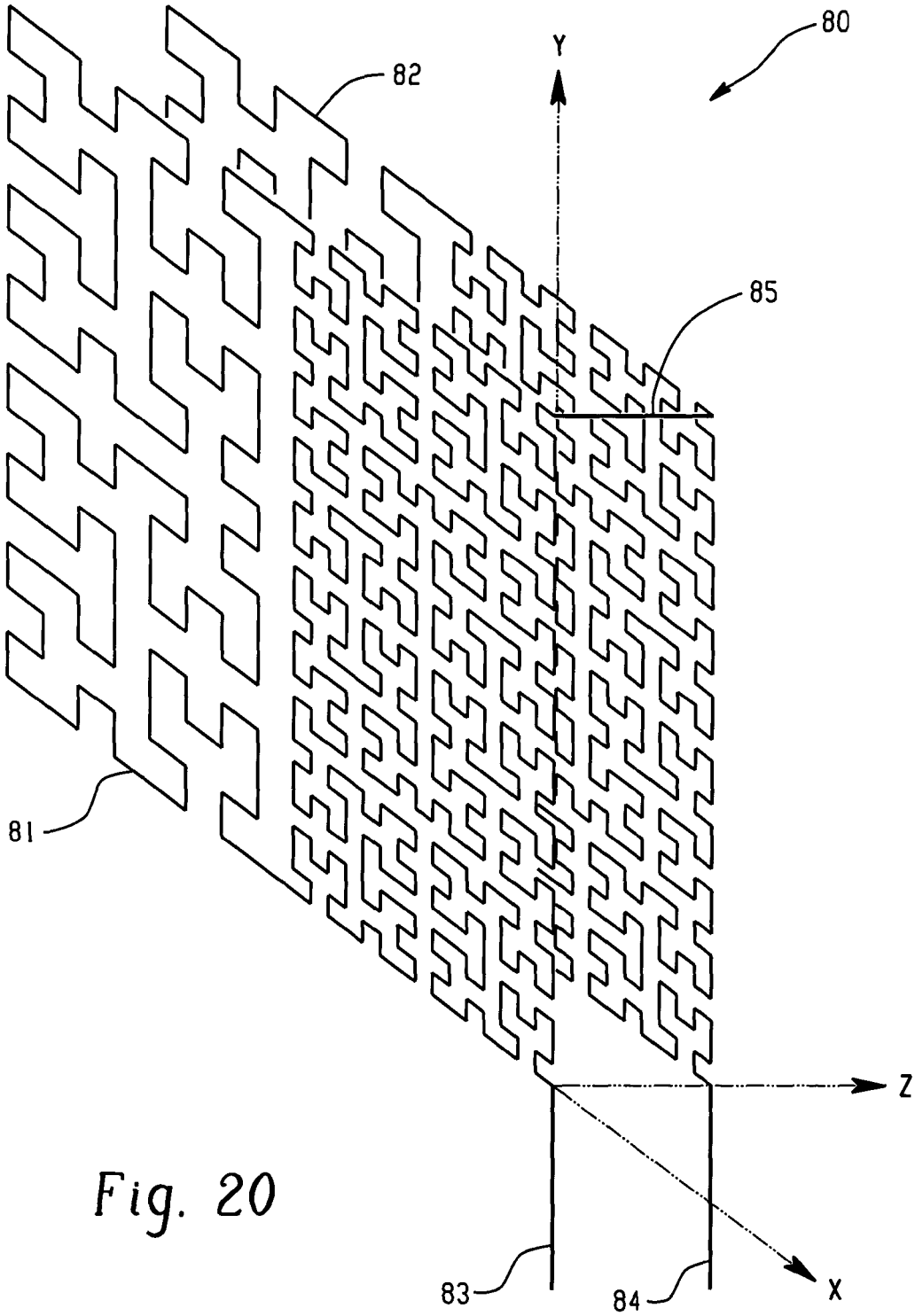
FIG. 20 is a three-dimensional view of a cascaded space-filling antenna structure 80 having two vertically stacked radiating arms.

FIG. 20 is a three-dimensional view of a cascaded space-filling antenna structure 80 having two vertically stacked radiating arms 81, 82. Also shown are x, y, and z axes to help illustrate the orientation of the antenna 80. Each radiating arm 81, 82 is similar to the cascaded antenna structure 40 of FIG. 16. More particularly, a first radiating arm 81 includes four cascaded sections that each define a space-filling curve in the xy plane. Similarly, a second radiating arm 82 includes four cascades sections that each define a space-filling curve parallel to the xy plane. The first radiating arm 81 forms a continuous conductive path from an antenna feeding point 83 to a common conductor 85, and the second radiating arm 82 forms a continuous conductive path from the common conductor 85 to a grounding point 84. That is, the antenna 80 forms one continuous conductive path from the antenna feeding point 83 on the first radiating arm 81 to the grounding point 84 on the second radiating arm 82. In one embodiment, the two radiating arms 83, 84 may be attached to opposite sides of a dielectric substrate, such as a printed circuit board.

Figure 21:
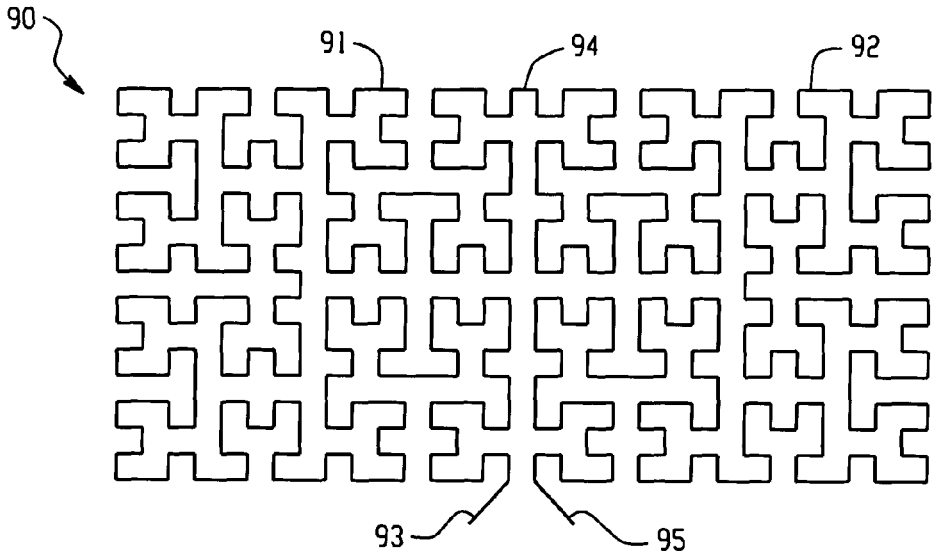
FIG. 21 illustrates another example cascaded space-filling antenna structure for use in an antenna system for a motor vehicle.

FIG. 21 illustrates another example cascaded space-filling antenna structure 90 for use in an antenna system for a motor vehicle. The space-filling antenna 90 includes two cascaded sections 91, 92 that each define a space-filling curve. The cascaded sections 91, 92 both include a conductor that extends in a continuous space-filling curve, wherein the space-filling curve defined by one section 91 is a mirror image of the space-filling curve defined by the other section 92. More particularly, a first section 92 of the space-filling antenna 90 extends in a continuous space-filling curve from a feeding point 93 to a common point 94, and a second section 92 of the space-filling antenna 90 extends in a continuous space-filling curve from the common point 94 to a grounding point 95.

Figure 22:
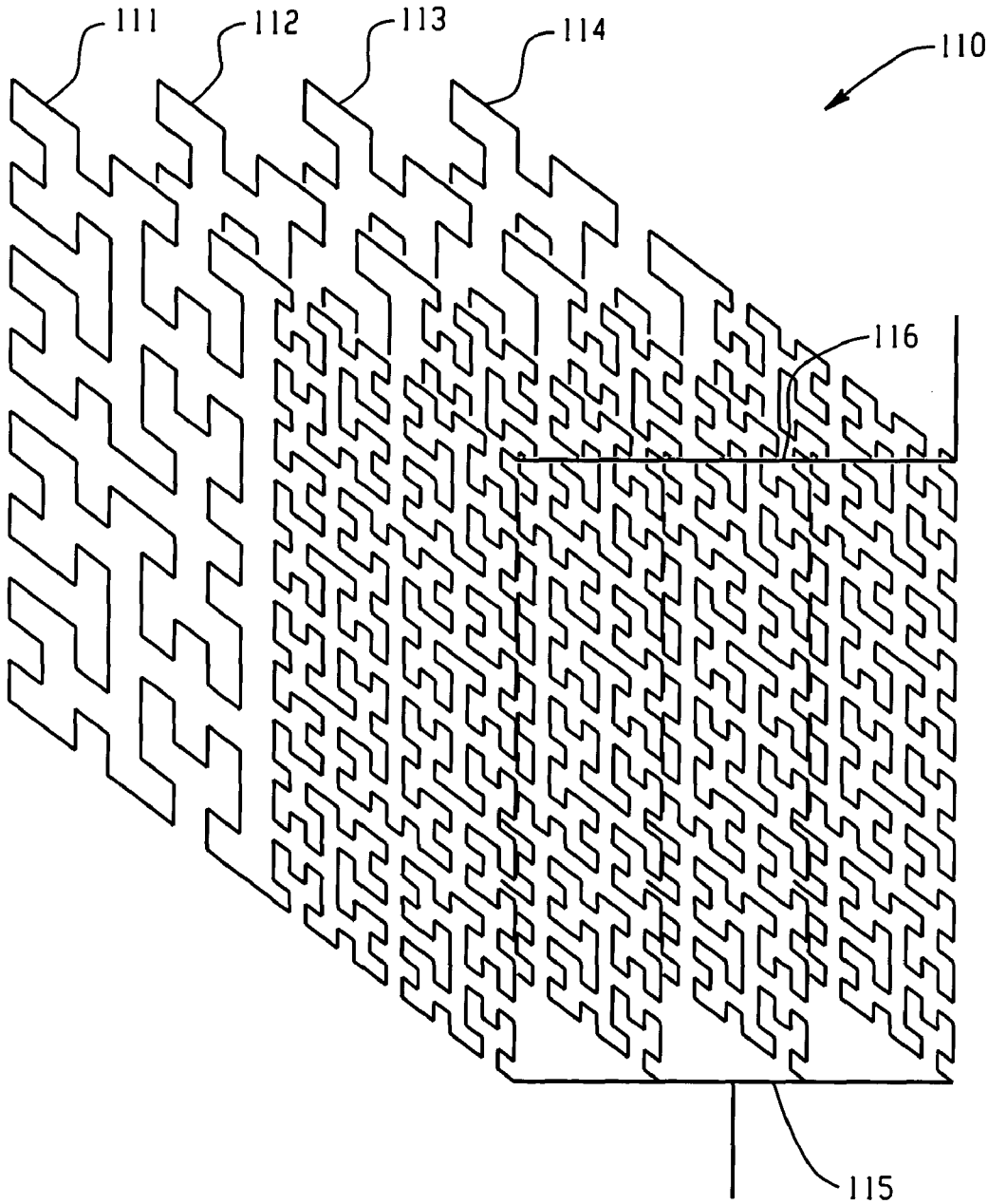
FIG. 22 is a three-dimensional view of a cascaded space-filling antenna structure having a plurality of parallel-fed vertically stacked radiating arms.

FIG. 22 is a three-dimensional view of a cascaded space-filling antenna structure 110 having a plurality of parallel-fed vertically stacked radiating arms 111-114. This embodiment 110 is similar to the antenna structure 80 of FIG. 20, except that this antenna 110 includes a common feeding point 115 and a plurality of radiating arms 111-114. Each radiating arm 111-114 defines four cascaded space-filling curves, with each of the radiating arms 111-114 lying in a parallel plane. The cascaded space-filling curves defined by each parallel radiating arm 111-114 extend continuously within their respective planes from a common feeding point 115 to a common conductor 116. The common conductor 116 may, for example, be coupled to a ground potential. In one embodiment, the radiating arms 111-114 may be separated by a dielectric substrate, such as layers in a multi-layer printed circuit board.

Figure 23:
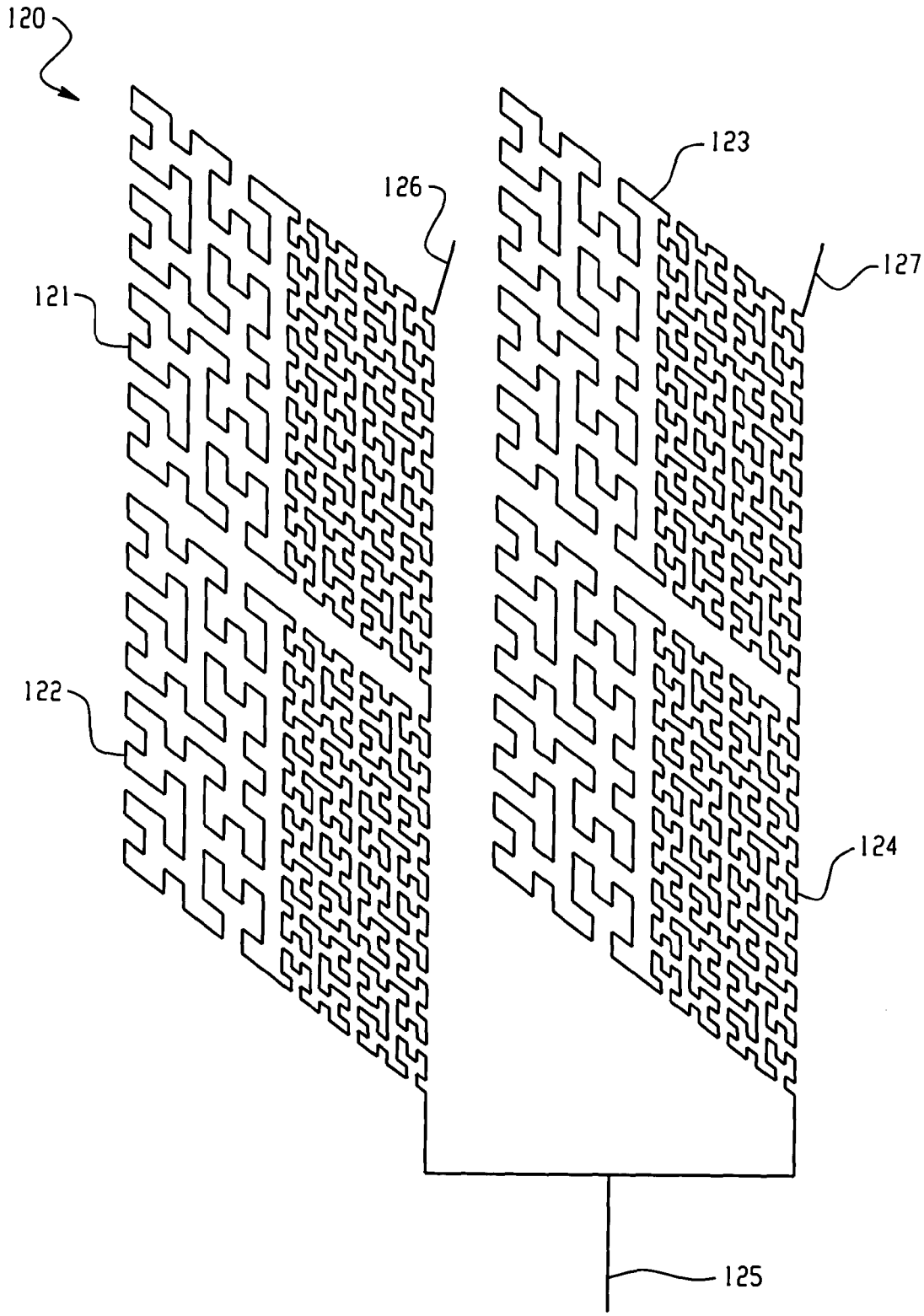
FIG. 23 is a three-dimensional view of a cascaded space-filling antenna structure having two parallel-fed radiating arms.

FIG. 23 is a three-dimensional view of a cascaded space-filling antenna structure 120 having two parallel-fed radiating arms. The two radiating arms each include two cascaded sections 121-124, with each of the four cascading sections 121-124 being similar to the cascaded space-filling antenna structure 40 of FIG. 16. More particularly, a first radiating arm 121, 122 extends continuously, defining a plurality of space-filling curves, from a common feeding point 125 to a first endpoint 126. Similarly, a second radiating arm 123, 124 extends continuously, defining a plurality of space-filling curves, from the common feeding point 125 to a second endpoint 127. In one embodiment, the first and second endpoints 126, 127 may be coupled to a ground potential, providing two parallel paths between the common feeding point 125 and ground.

Figure 24:
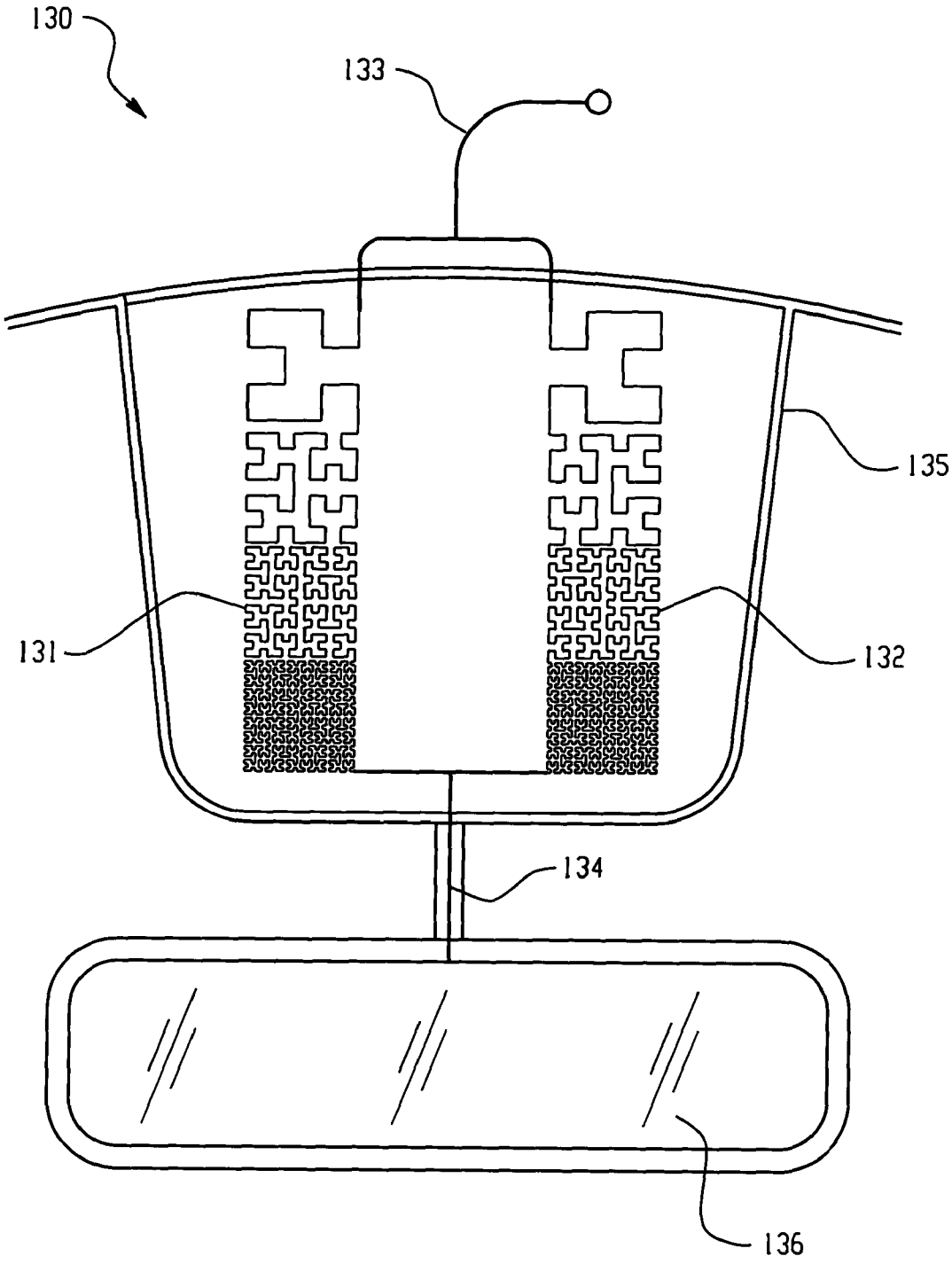
FIG. 24 illustrates another embodiment of a cascaded space-filling antenna structure mounted within the housing of a rear view mirror.

FIG. 24 illustrates another embodiment of a cascaded space-filling antenna structure 130 mounted within the housing of a rear view mirror 135. This antenna structure 130 includes two parallel-fed radiating arms 131, 132, each of which defines four cascaded space-filling curves, similar to the cascaded antenna structure 30 of FIG. 15. More particularly, both radiating arms 131, 132 extends continuously, defining a plurality of space-filling curves, from a common feeding point 133 to a common loading or grounding point 134. That is, the radiating arms 131, 132 provide two parallel conductive paths between the common feeding point 133 and the common loading or grounding point 134. As illustrated, the cascaded space-filling antenna structure 130 may be mounted, for example, within the housing 135 of the rear view mirror in an automobile. The loading point 134 of the antenna 130 may, for example, be coupled to the metallic surface 136 of the mirror, or to some other conducting load. The feeding point 133 may be coupled to circuitry within the automobile to provide an antenna for AM/FM signal reception, DAB/AM signal reception, cellular or GPS service, or other wireless applications.

Figure 25:
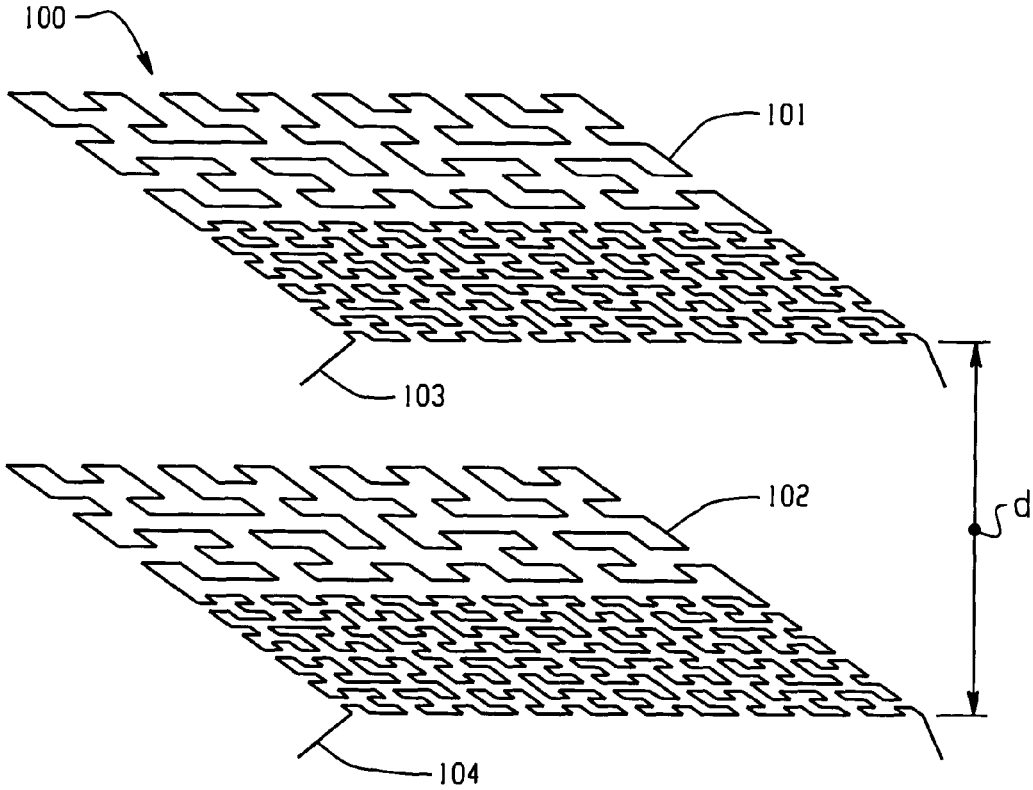
FIG. 25 is a three-dimensional view of a cascaded space-filling antenna structure having an active radiating arm and a parasitic radiating arm.

FIG. 25 is a three-dimensional view of a cascaded space-filling antenna structure 100 having an active radiating arm 101 and a parasitic radiating arm 102. This embodiment 100 is similar to the antenna structure show in FIG. 20, except that this embodiment 100 does not include a common conductor 85 connecting the two radiating arms. Rather, in this embodiment 100, one radiating arm 101 includes a feeding point 103 for the antenna 100, and the other radiating arm 102 is coupled to a ground potential at a grounding point 104. The active and passive radiating arms 101, 102 are separated by a distance (d) that is selected to enable electromagnetic coupling between the two antenna portions 101, 102.

FIGS. 26-29 illustrate an example two-dimensional antenna geometry 140 referred to as a grid dimension curve. An antenna structure defining a grid dimension curve, as defined below, may be substituted for any of the space-filling antenna structures described above with reference to FIGS. 1-25.

The grid dimension of a curve may be calculated as follows. A first grid having square cells of length L1 is positioned over the geometry of the curve, such that the grid completely covers the curve. The number of cells (N1) in the first grid that enclose at least a portion of the curve are counted. Next, a second grid having square cells of length L2 is similarly positioned to completely cover the geometry of the curve, and the number of cells (N2) in the second grid that enclose at least a portion of the curve are counted. In addition, the first and second grids should be positioned within a minimum rectangular area enclosing the curve, such that no entire row or column on the perimeter of one of the grids fails to enclose at least a portion of the curve. The first grid should include at least twenty-five cells, and the second grid should include four times the number of cells as the first grid. Thus, the length (L2) of each square cell in the second grid should be one-half the length (L1) of each square cell in the first grid. The grid dimension ($D_g$) may then be calculated with the following equation:

$$D_g = -\frac{\log(N2) - \log(N1)}{\log(L2) - \log(L1)}.$$

For the purposes of this application, the term grid dimension curve is used to describe a curve geometry having a grid dimension that is greater than one (1). The larger the grid dimension, the higher the degree of miniaturization that may be achieved by the grid dimension curve in terms of an antenna operating at a specific frequency or wavelength. In addition, a grid dimension curve may, in some cases, also meet the requirements of a space-filling curve, as defined above. Therefore, for the purposes of this application a space-filling curve is one type of grid dimension curve.

Figure 26:
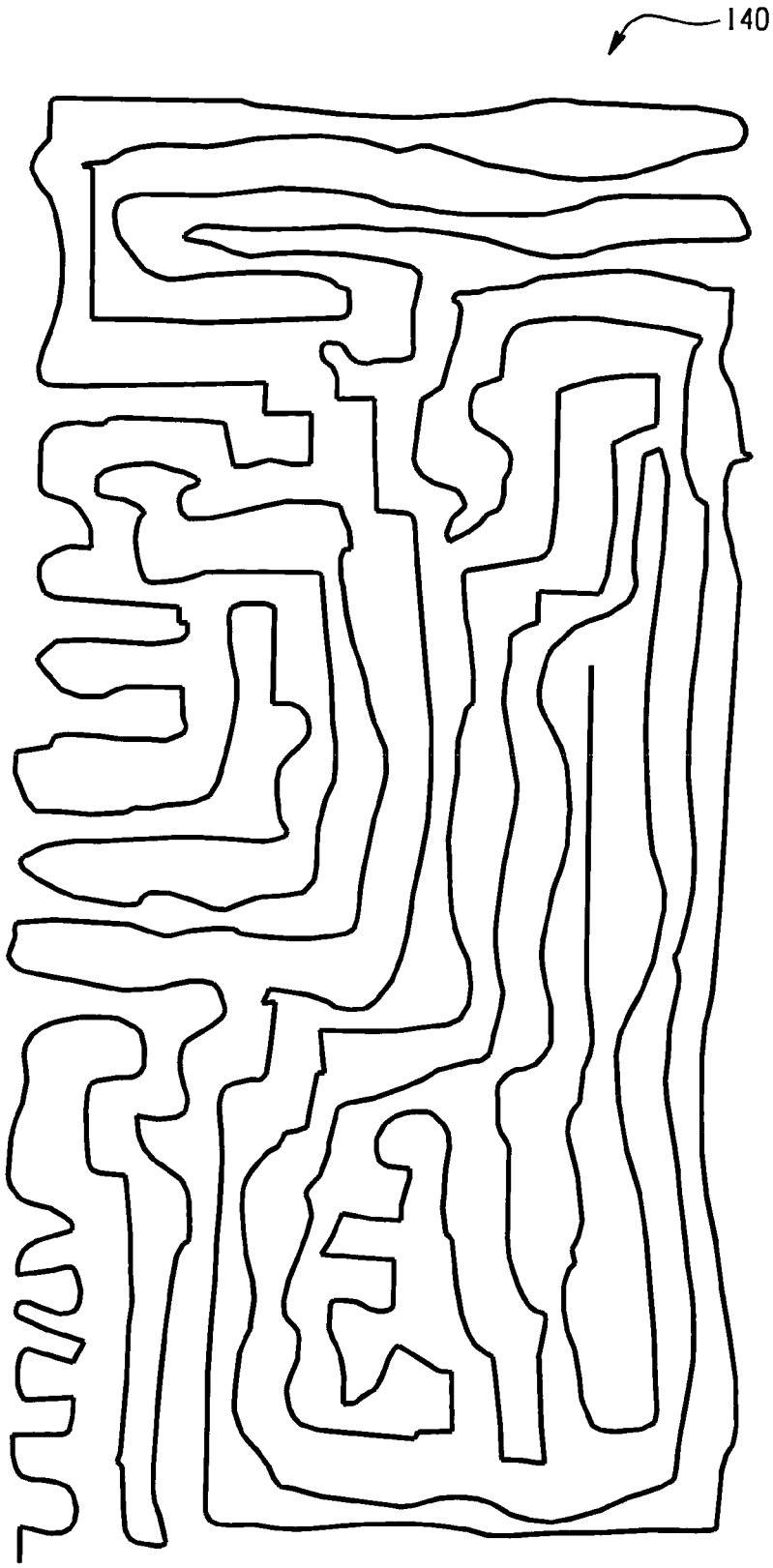
FIGS. 26-29 illustrate an example two-dimensional antenna geometry referred to as a grid dimension curve.
Figure 27:
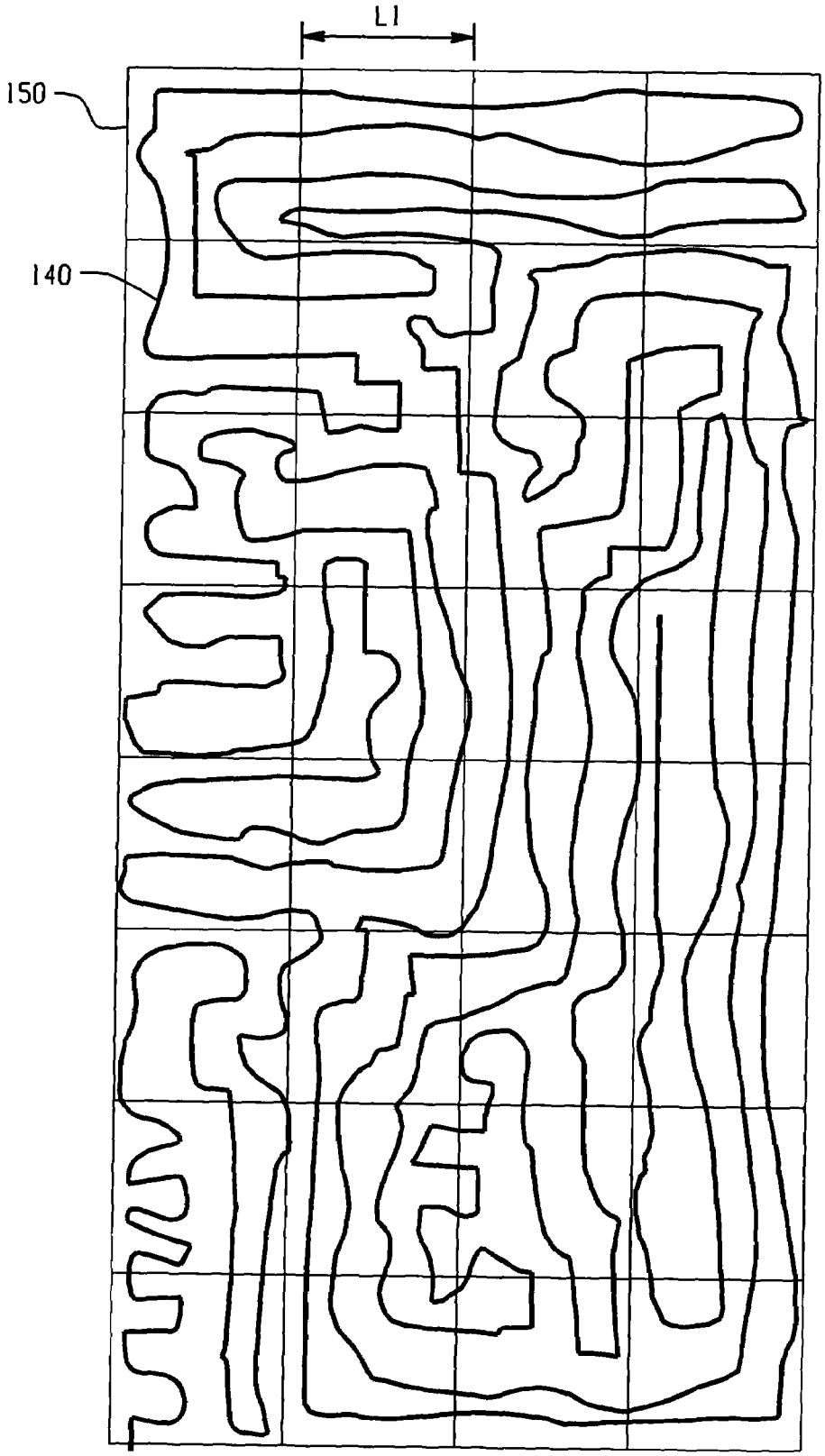
Figure 28:
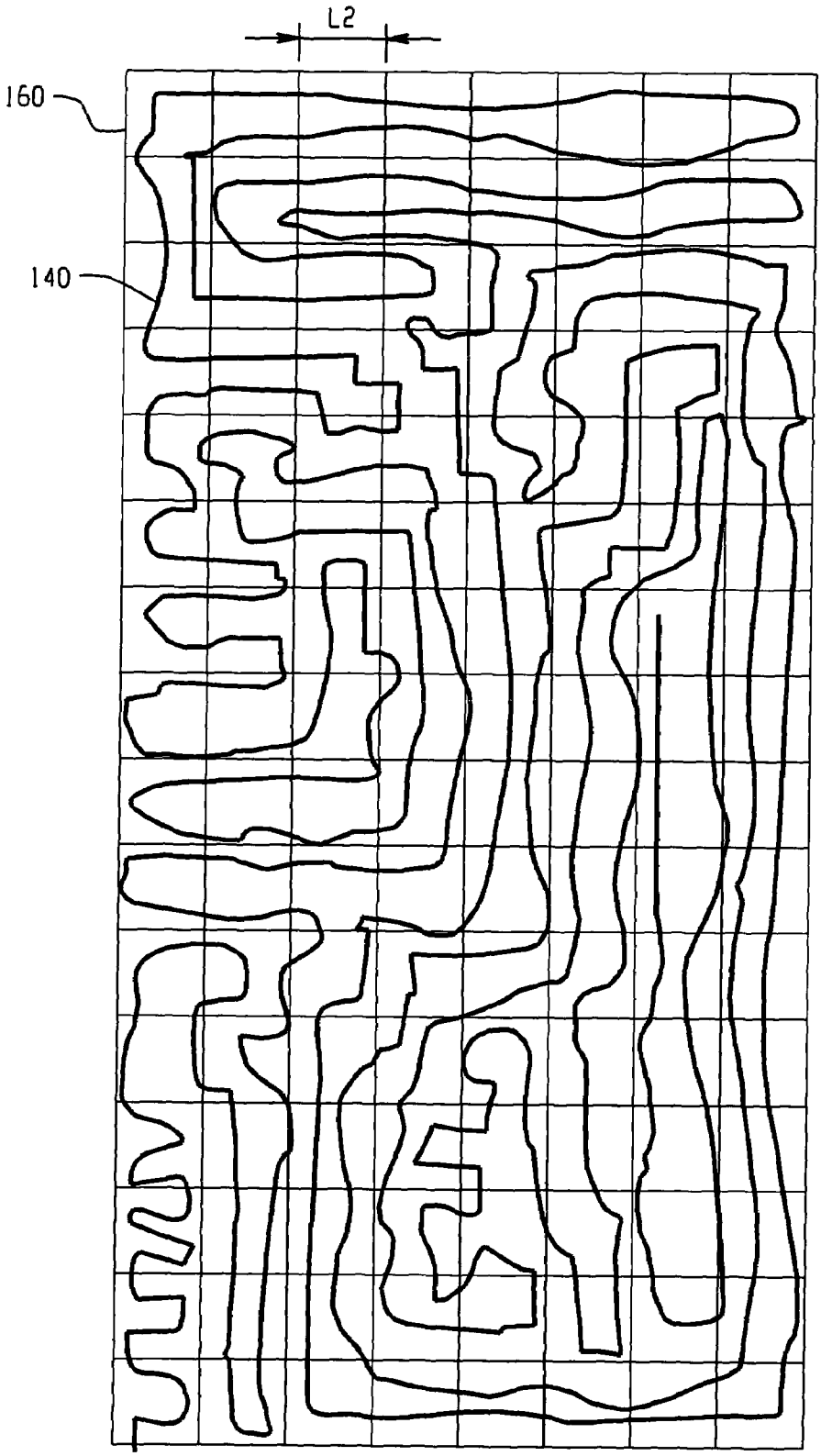

FIG. 26 shows an example two-dimensional antenna 140 forming a grid dimension curve with a grid dimension of approximately two (2). FIG. 27 shows the antenna 140 of FIG. 26 enclosed in a first grid 150 having thirty-two (32) square cells, each with a length L1. FIG. 28 shows the same antenna 140 enclosed in a second grid 160 having one hundred twenty-eight (128) square cells, each with a length L2. The length (L1) of each square cell in the first grid 150 is twice the length (L2) of each square cell in the second grid 160 (L2=2×L1). An examination of FIGS. 27 and 28 reveal that at least a portion of the antenna 140 is enclosed within every square cell in both the first and second grids 150, 160. Therefore, the value of N1 in the above grid dimension ($D_g$) equation is thirty-two (32) (i.e., the total number of cells in the first grid 150), and the value of N2 is one hundred twenty-eight (128) (i.e., the total number of cells in the second grid 160). Using the above equation, the grid dimension of the antenna 140 may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependant upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 29:
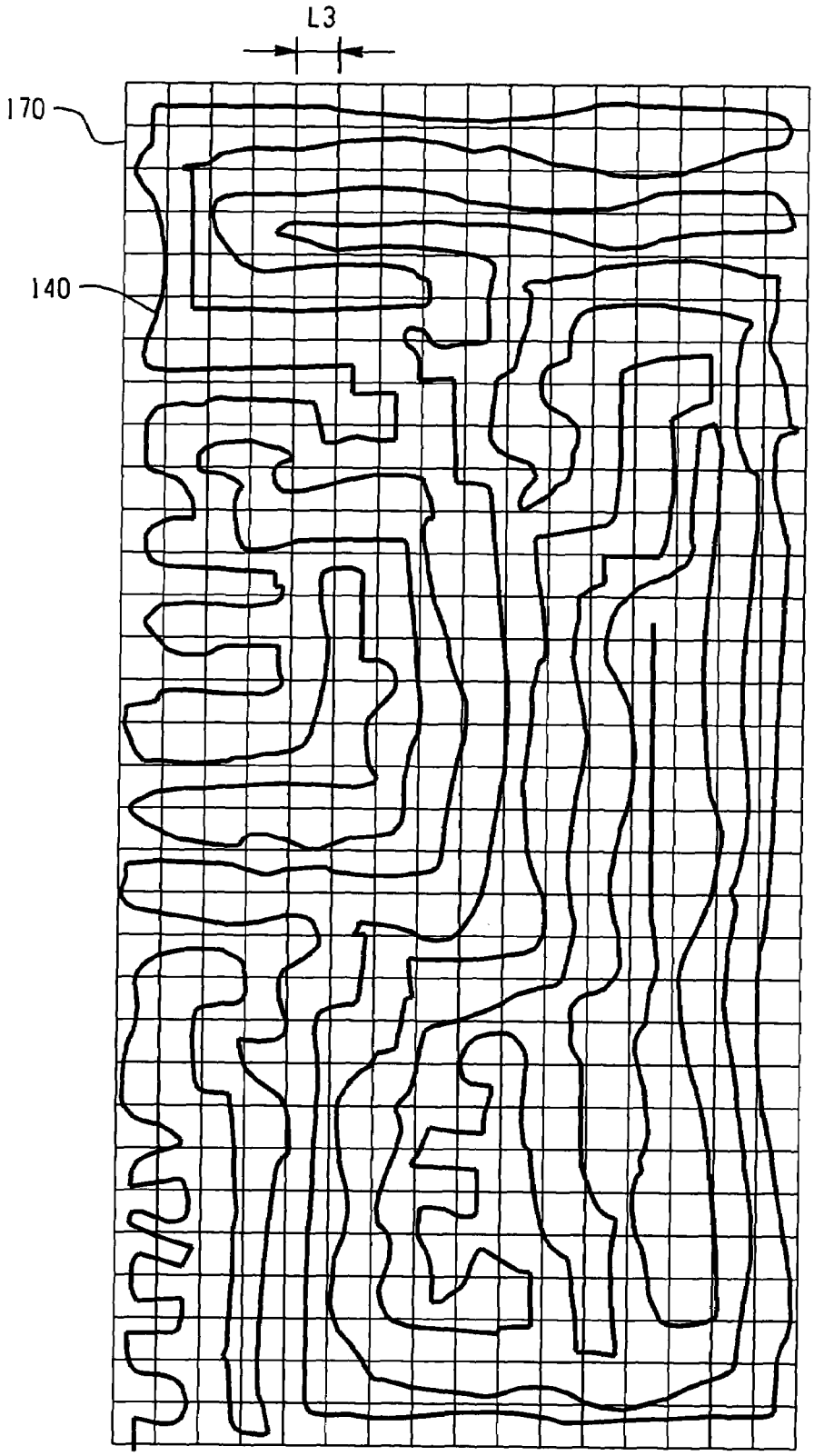

For example, FIG. 29 shows the same antenna 140 enclosed in a third grid 170 with five hundred twelve (512) square cells, each having a length L3. The length (L3) of the cells in the third grid 170 is one half the length (L2) of the cells in the second grid 160, shown in FIG. 28. As noted above, a portion of the antenna 140 is enclosed within every square cell in the second grid 160, thus the value of N for the second grid 160 is one hundred twenty-eight (128). An examination of FIG. 29, however, reveals that the antenna 140 is enclosed within only five hundred nine (509) of the five hundred twelve (512) cells of the third grid 170. Therefore, the value of N for the third grid 170 is five hundred nine (509). Using FIGS. 28 and 29, a more accurate value for the grid dimension (D) of the antenna 140 may be calculated as follows:

$$D_g = -\frac{\log(509) - \log(128)}{\log(2 \times L2) - \log(L2)} \approx 1.9915$$

Figure 30:
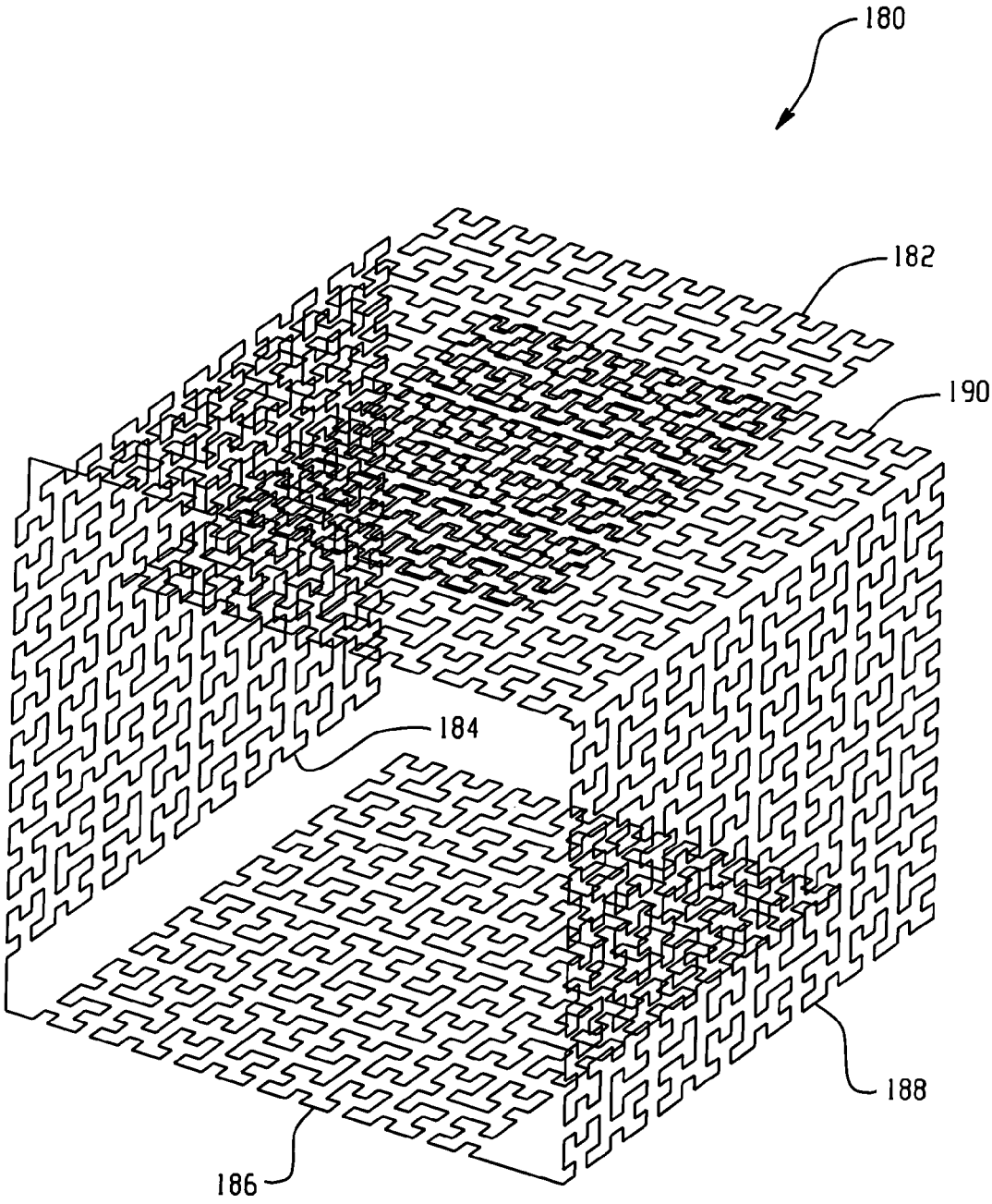
FIGS. 30 and 31 illustrate two additional antenna structures for use in an antenna system for a motor vehicle.
Figure 31:
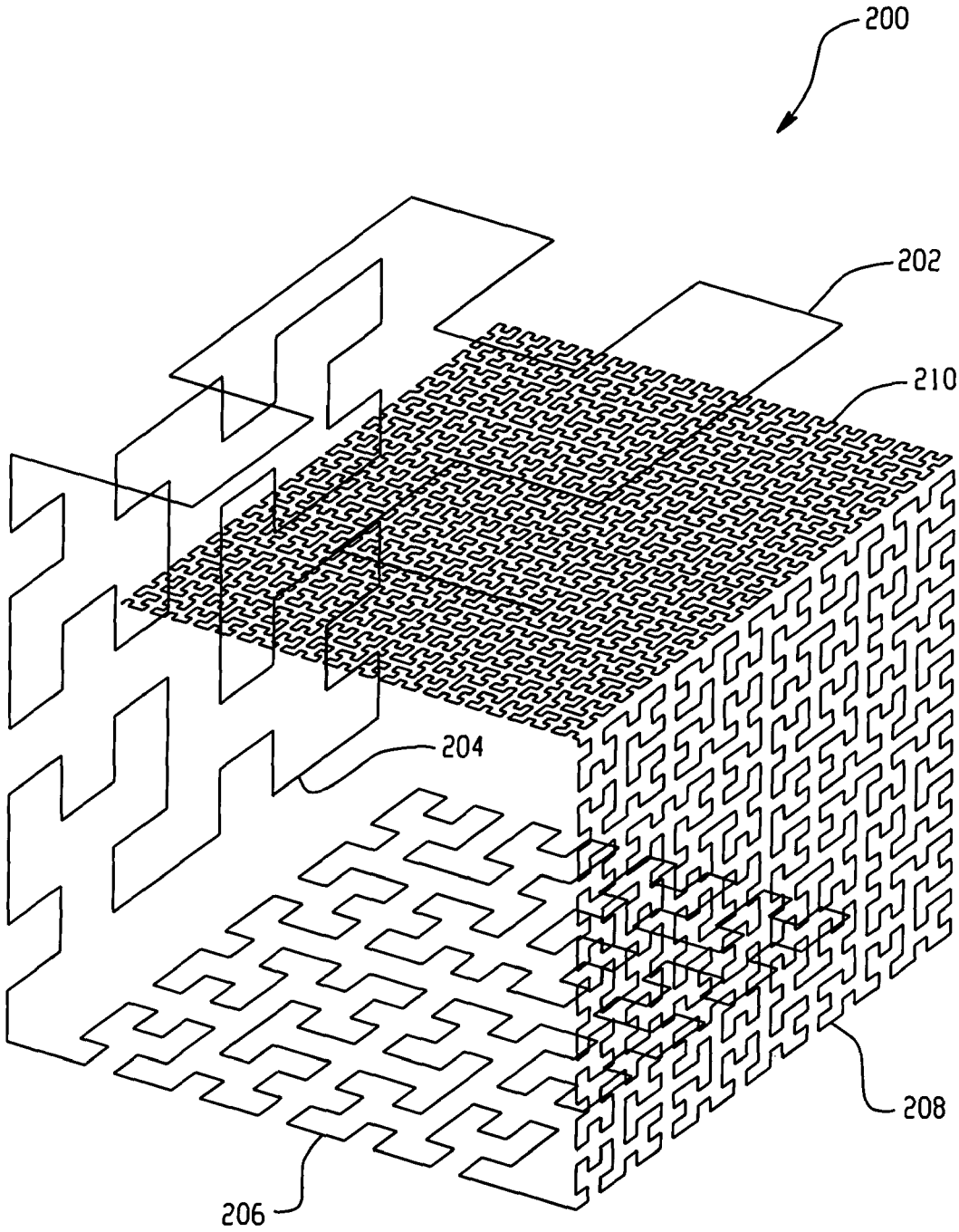

FIGS. 30 and 31 illustrate two additional antenna structures 180, 200 for use in an antenna system for a motor vehicle. More particularly, FIGS. 30 and 31 illustrate two non-planar antenna embodiments 180, 200. Either of these antenna structures 180, 200 may, for example, be substituted for any of the space-filling antennas 5, 9, described above with reference to FIGS. 1-13.

FIG. 30 illustrates an example non-planar antenna structure 180 having a plurality of cascaded folded sections 182-190. The folded sections 182-190 of the antenna 180 each define a space-filling curve, and are cascaded such that the antenna 180 extends in one continuous conductive path between two endpoints. The sections 182-190 of the antenna structure 180 are folded such that each section 182-190 lies in a plane that is perpendicular to an adjacent section, and two end sections 182, 190 lie in parallel planes.

FIG. 31 illustrates another example non-planar antenna structure 200 having a plurality of cascaded folded sections 202-210. This embodiment 200 is similar to the antenna 180 shown in FIG. 30, except that each of the folded sections 202-210 shown in FIG. 31 form space-filling curves having a different length and a different number of connected segments.

It should be understood that the cascaded sections 182-190 and 202-210 of the antennas 180, 200 shown in FIGS. 30 and 31 may also define grid dimension curves, as described above with reference to FIGS. 26-29. In addition, the antenna structures 180, 200 may alternatively be attached to a flexible substrate material, such as a flex-film printed circuit board. The folded sections 182-190 and 202-210 of the non-planar antennas 180, 200 may, for example, be wrapped around inside the base of a rear-view mirror in a motor vehicle, but could also be integrated into other physical components of the motor vehicle.

This written description uses examples to disclose the invention, including the best mode, and also to enable a person skilled in the art to make and use the invention. The patentable scope of the invention is defined by the claims, and may include other examples that occur to those skilled in the art. For example, each of the antennas incorporated in the integrated multiservice antenna systems, described above, could be individualized while keeping the features previously described, this possibility is especially well-suited for low or medium class vehicles, in which only one antenna type is installed.

It is claimed:

1. An antenna system integrated with a physical component of a motor vehicle, comprising:

a radio antenna;

the radio antenna having a radiating arm, at least a portion of the radiating arm defining a space-filling geometry;

the radio antenna further having a feeding point for coupling the radio antenna to a radio receiver in the motor vehicle;

wherein the space-filling geometry includes at least two hundred segments with each segment being smaller than 34 millimeters; and wherein the entire space-filling geometry contributes to the radiation characteristics of the radio antenna;

wherein the segments in the space-filling geometry are each less than one hundredth of the free-space operating wavelength in the FM band.

2. The antenna system of claim 1, wherein the space-filling geometry includes a plurality of connected segments with each segment forming a right angle with an adjacent connected segment.

3. The antenna system of claim 1, wherein the space-filling geometry includes a plurality of connected segments, and wherein each segment of the space-filling geometry defines a straight line.

4. The antenna system of claim 1, wherein the radio antenna is attached to a dielectric substrate.

5. The antenna system of claim 1, wherein the antenna system is integrated within an interior rearview mirror assembly.

6. The antenna system of claim 5, wherein the radio antenna is integrated within a base support of the rearview mirror assembly.

7. The antenna system of claim 1, wherein the antenna system is integrated within an exterior light assembly.

8. The antenna system of claim 7, wherein the antenna system is integrated within a rear brake-light assembly.

9. The antenna system of claim 1, wherein the feeding point of the radio antenna is a portion of the radiating arm.

10. The antenna system of claim 1, wherein the radio antenna includes a grounding point for coupling the radio antenna to a ground counterpoise.

11. The antenna system of claim 1, wherein the radio antenna includes a loading point for coupling the radio antenna to a conductive load.

12. The antenna system of claim 11, wherein the conductive load is a metallic portion of a rearview mirror assembly.

13. The antenna system of claim 1, wherein the radio antenna is configured to operate as a FM band antenna.

14. The antenna system of claim 1, wherein the radio antenna is configured to operate as an AM band antenna.

15. The antenna system of claim 1, wherein the radio antenna is configured to operate as a DAB band antenna.

16. The antenna system of claim 1, further comprising:

a cellular telephony antenna;

the cellular telephony antenna having a first conducting sheet;

the cellular telephony antenna further having a second conducting sheet coupled to the first conducting sheet that functions as a ground counterpoise for the cellular telephony antenna.

17. The antenna system of claim 16, wherein the first conducting sheet has a length that is smaller than one quarter of the free-space operating wavelength of the cellular telephony antenna.

18. The antenna system of claim 16, wherein the first conducting sheet lies in a first plane and the second conducting sheet lies in a second plane, with the first plane being parallel to the second plane.

19. The antenna system of claim 16, wherein the cellular telephony antenna includes a conducting pin for coupling the first conducting sheet to cellular transceiver circuitry in the motor vehicle.

20. The antenna system of claim 19, wherein the conducting pin is coupled by direct ohmic contact to the first conducting sheet.

21. The antenna system of claim 19, wherein the conducting pin is coupled to the first conducting sheet by capacitive coupling.

22. The antenna system of claim 16, wherein the cellular telephony antenna configured to transmit and receive cellular telephony signals in a cellular band selected from the group consisting of GSM 900, GSM 1800, UMTS, WCDMA, CDMA, PCS 1900, KPCS, AMPS, TACS and ETACS.

23. The antenna system of claim 16, wherein the first conducting sheet includes a perimeter that defines a space-filling geometry.

24. The antenna system of claim 16, wherein the second conducting sheet includes a perimeter that defines a space-filling geometry.

25. The antenna system of claim 1, further comprising:

a cellular telephony antenna, wherein at least a portion of the cellular telephony antenna defines a space-filling geometry.

26. The antenna system of claim 1, further comprising:

a satellite-signal antenna that forms a microstrip antenna with circular polarization;

the satellite-signal antenna having a first conducting sheet and a second conducting sheet, with the first conducting sheet being separated from the second conducting sheet by a dielectric material.

27. The antenna system of claim 26, further comprising:

a low-noise, high-gain amplifier coupled between the satellite-signal antenna and satellite-signal receiver circuitry in the motor vehicle.

28. The antenna system of claim 26, wherein the satellite-signal antenna is configured to receive global positioning satellite (GPS) signals.

29. The antenna system of claim 26, wherein the first conducting sheet includes a perimeter that defines a space-filling geometry.

30. The antenna system of claim 26, wherein the second conducting sheet includes a perimeter that defines a space-filling geometry.

31. The antenna system of claim 26, wherein the satellite-signal antenna is integrated within an exterior rearview mirror housing.

32. The antenna system of claim 1, further comprising a cellular telephony antenna having a radiating arm that defines a space-filling geometry.

33. The antenna system of claim 32, wherein the cellular telephony antenna is configured to transmit and receive cellular telephony signals in a cellular band selected from the group consisting of GSM 900, GSM 1800, UMTS, WCDMA, CDMA, PCS 1900, KPCS, AMPS, TACS and ETACS.

34. A multi-service antenna system for a motor vehicle, comprising a plurality of antenna structures integrated within a physical component of the motor vehicle, the plurality of antenna structures including a radio antenna and at least one of a cellular telephony antenna and a satellite-signal antenna;

the radio antenna having a radiating arm, at least a portion of the radiating arm defining a space-filling geometry;

the radio antenna further having a feeding point for coupling the radio antenna to a radio receiver in the motor vehicle;

wherein the space-filling geometry includes a plurality of connected segments with each segment having a length that is smaller than one hundredth of the free-space operating wavelength of the radio antenna in the FM band; and wherein each of the segments of the space-filling geometry provide a radiating segment of the radio antenna.

35. The multi-service antenna system of claim 34, wherein the space-filling geometry includes a plurality of connected segments, wherein each segment defines a straight line.

36. The multi-service antenna system of claim 34, wherein the space-filling geometry includes a plurality of connected segments, and wherein at least one segment of the space-filling geometry is non-linear.

37. The multi-service antenna system of claim 34, wherein the plurality of antenna structures are integrated within an interior rearview mirror assembly.

38. The multi-service antenna system of claim 34, wherein the plurality of antenna structures are integrated within a bumper.

39. The multi-service antenna system of claim 34, wherein the plurality of antenna structures are integrated with a sunroof.

40. The multi-service antenna system of claim 34, wherein the cellular telephony antenna includes a first conducting sheet and a second conducting sheet coupled to the first conducting sheet, wherein the first conducting sheet is coupled to cellular transceiver circuitry in the motor vehicle and the second conducting sheet is coupled to a metallic surface of the motor vehicle.

41. The multi-service antenna system of claim 40, wherein the first conducting sheet of the cellular telephony antenna includes a perimeter that defines a space-filling geometry.

42. The multi-service antenna system of claim 34, wherein at least a portion of the cellular telephony antenna defines a space-filling geometry.

43. The multi-service antenna system of claim 34, wherein the satellite-signal antenna is a microstrip antenna having circular polarization.

44. The multi-service antenna system of claim 43, wherein the satellite-signal antenna includes a first conducting sheet and a second conducting sheet, wherein the first conducting sheet is separated from the second conducting sheet by a dielectric material.

45. The multi-service antenna system of claim 44, wherein at least one of the first conducting sheet and the second conducting sheet includes a perimeter that defines a space-filling geometry.

46. The multi-service antenna system of claim 34, wherein the radio antenna includes an inductor coupled in series with the feeding point.

47. The multi-service antenna system of claim 34, wherein the radiating arm of the radio antenna includes a plurality of cascaded sections, each cascaded section defining a space-filling geometry.

48. The multi-service antenna system of claim 47, wherein the space-filling geometries defined by the cascaded sections each have a different conductor length and a different number of connected segments.

49. The multi-service antenna system of claim 47, wherein a first half of the space-filling geometries each have a first conductor length and a first number of connected segments and a second half of the space-filling geometries each have a second conductor length and a second number of connected segments.

50. The multi-service antenna system of claim 47, wherein the cascaded sections are co-planar.

51. The multi-service antenna system of claim 47, wherein the radiating arm of the radio antenna includes a first section cascaded with a second section, and wherein the first section is a mirror image of the second section.

52. The multi-service antenna system of claim 34, wherein the radio antenna further includes an additional radiating arm, at least a portion of the additional radiating arm defining a space-filling geometry.

53. The multi-service antenna system of claim 52, wherein:

the radiating arm of the radio antenna includes a first plurality of cascaded sections, each of the first plurality of cascaded sections defining a space-filling geometry; and the additional radiating arm of the radio antenna includes a second plurality of cascaded sections, each of the second plurality of cascaded sections defining a space-filling geometry.

54. The multi-service antenna system of claim 52, wherein radiating arm is coupled to the additional radiating arm, forming a continuous conductive path from a first endpoint on the radiating arm to a second endpoint on the additional radiating arm.

55. The multi-service antenna system of claim 54, wherein the first endpoint is an antenna feeding point.

56. The multi-service antenna system of claim 54, wherein the second endpoint is coupled to a ground counterpoise.

57. The multi-service antenna system of claim 52, wherein the radiating arm lies in a first plane and the additional radiating arm lies in a second plane, wherein the first plane is parallel to the second plane.

58. The multi-service antenna system of claim 57, wherein the radiating arm is separated by distance from the additional radiating arm, and wherein the distance between the radiating arm and the additional radiating arm is small enough to enable electromagnetic coupling between the radiating arm and the additional radiating arm.

59. The multi-service antenna system of claim 34, wherein the radio antenna further includes a plurality of additional radiating arms each lying in a plane parallel to the radiating arm.

60. The multi-service antenna system of claim 59, wherein the radiating arm and the plurality of additional radiating arms have a common feeding point.

61. The multi-service antenna system of claim 60, wherein the radiating arm and the plurality of additional radiating arms have a common grounding point.

62. The multi-service antenna system of claim 59, wherein the plurality of additional radiating arms each define a space-filling geometry.

63. The multi-service antenna system of claim 34, wherein the radiating arm of the radio antenna comprises:

a plurality of cascaded sections, each cascaded section defining a space-filling geometry; and a top-loading portion coupled to one of the cascaded sections.

64. The multi-service antenna system of claim 63, wherein the top-loading portion is a conductive plate.

65. The multi-service antenna system of claim 63, wherein the top-loading portion is a metallic surface of the motor vehicle.

66. The multi-service antenna system of claim 65, wherein the top-loading portion is a metallic surface within an interior rearview mirror assembly.

67. The multi-service antenna system of claim 34, wherein the radiating arm of the radio antenna includes a metallic plate that defines a slot, and wherein the slot defines the space-filling geometry.

68. The multi-service antenna system of claim 47, wherein the radiating arm of the radio antenna includes five cascaded sections, each cascaded section lying in a plane that is perpendicular to an adjacent cascaded section and two of the cascaded sections lying in parallel planes.

69. A multi-service antenna system for a motor vehicle, comprising a plurality of antenna structures integrated within a physical component of the motor vehicle, the plurality of antenna structures including a radio antenna and at least one of a cellular telephony antenna or a satellite-signal antenna;

the radio antenna having a radiating arm, at least a portion of the radiating arm defining a grid dimension curve that includes at least 200 segments with each segment being less than 34 millimeters;

the radio antenna further having a feeding point for coupling the radio antenna to a radio receiver in the motor vehicle; and wherein the entire grid dimension curve contributes to the radiation characteristics of the radio antenna.

70. The multi-service antenna system of claim 69, wherein at least a portion of the cellular telephony antenna defines a grid dimension curve.

71. The multi-service antenna system of claim 69, wherein at least a portion of the satellite-signal antenna defines a grid dimension curve.

72. An antenna system integrated with a physical component of a motor vehicle, comprising:

a radio antenna;

the radio antenna having a radiating arm, at least a portion of the radiating arm defining a space-filling geometry;

the radio antenna further having a feeding point for coupling the radio antenna to a radio receiver in the motor vehicle;

wherein the space-filling geometry includes at least two hundred segments with each segment being smaller than 34 millimeters; and wherein the entire space-filling geometry contributes to the radiation characteristics of the radio antenna wherein the segments in the space-filling geometry are each less than one hundredth of the free-space operating wavelength in the DAB band.

73. An antenna system integrated with a physical component of a motor vehicle, comprising:

a radio antenna;

the radio antenna having a radiating arm, at least a portion of the radiating arm defining a space-filling geometry;

the radio antenna further having a feeding point for coupling the radio antenna to a radio receiver in the motor vehicle;

wherein the space-filling geometry includes at least two hundred segments with each segment being smaller than 34 millimeters; and wherein the entire space-filling geometry contributes to the radiation characteristics of the radio antenna wherein the space-filling geometry has a conductor length that is less than or equal to twenty percent of the length required for a straight quarter-wavelength monopole antenna operating in the FM band.

74. An antenna system integrated with a physical component of a motor vehicle, comprising:

a radio antenna;

the radio antenna having a radiating arm, at least a portion of the radiating arm defining a space-filling geometry;

the radio antenna further having a feeding point for coupling the radio antenna to a radio receiver in the motor vehicle;

wherein the space-filling geometry includes at least two hundred segments with each segment being smaller than 34 millimeters; and wherein the entire space-filling geometry contributes to the radiation characteristics of the radio antenna wherein the space-filling geometry has a conductor length that is less than or equal to twenty percent of the length required for a straight quarter-wavelength monopole antenna operating in the DAB band.

75. A radio, cellular telephony or satellite-signal antenna for integration within a physical component of a motor vehicle, comprising:

a feeding point for coupling the antenna to a receiver in the motor vehicle; and a radiating arm having a plurality of cascaded sections, each cascaded section defining a space-filling curve having at least ten segments, each of which forming an angle with each adjacent segment, and the space-filling curves of the cascaded sections being different iterations of the same curve on a different scale and having a different length and having a different number of segments.

76. A multi-service antenna system for a motor vehicle, comprising:

a plurality of antenna structures integrated within a physical component of the motor vehicle, the plurality of antenna structures including a radio antenna according to claim 75 and at least one of a cellular telephony antenna or a satellite-signal antenna.

77. The antenna system of claim 76, wherein the radio antenna is attached to a dielectric substrate.

78. The antenna system of claim 76, wherein the antenna system is integrated within an interior rearview mirror assembly.

79. The antenna system of claim 76, wherein the antenna system is integrated within an exterior light assembly.

80. The antenna system of claim 76, wherein the antenna system is integrated within a rear brake-light assembly.

81. The antenna system of claim 76, wherein the feeding point of the radio antenna is a portion of the radiating arm.

82. The antenna system of claim 76, wherein the radio antenna includes a grounding point for coupling the radio antenna to a ground counterpoise.

83. The antenna system of claim 76, wherein the radio antenna includes a loading point for coupling the radio antenna to a conductive load.

84. The antenna system of claim 83, wherein the conductive load is a metallic portion of a rearview mirror assembly.

85. The antenna system of claim 76, wherein the radio antenna is configured to operate as a FM band antenna.

86. The antenna system of claim 76, wherein the radio antenna is configured to operate as an AM band antenna.

87. The antenna system of claim 76, wherein the radio antenna is configured to operate as a DAB band antenna.

88. The antenna system of claim 76, wherein the cellular telephony antenna includes a first conducting sheet and a second conducting sheet coupled to the first conducting sheet, wherein the second conducting sheet functions as a ground counterpoise for the cellular telephony antenna.

89. The antenna system of claim 88, wherein the first conducting sheet has a length that is smaller than one quarter of the free-space operating wavelength of the cellular telephony antenna.

90. The antenna system of claim 88, wherein the first conducting sheet lies in a first plane and the second conducting sheet lies in a second plane, with the first plane being parallel to the second plane.

91. The antenna system of claim 88, wherein the cellular telephony antenna includes a conducting pin for coupling the first conducting sheet to cellular transceiver circuitry in the motor vehicle.

92. The antenna system of claim 91, wherein the conducting pin is coupled by direct ohmic contact to the first conducting sheet.

93. The antenna system of claim 91, wherein the conducting pin is coupled to the first conducting sheet by capacitive coupling.

94. The antenna system of claim 76, wherein the cellular telephony antenna is configured to transmit and receive cellular telephony signals in a cellular band selected from the group consisting of GSM 900, GSM 1800, UMTS, WCDMA, CDMA, PCS 1900, KPCS, AMPS, TACS and ETACS.

95. The antenna system of claim 76, wherein the satellite-signal antenna forms a microstrip antenna with circular polarization, the satellite-signal antenna having a first conducting sheet and a second conducting sheet, with the first conducting sheet being separated from the second conducting sheet by a dielectric material.

96. The antenna system of claim 95, further comprising a low-noise, high-gain amplifier coupled between the satellite-signal antenna and the satellite-signal receiver circuitry in the motor vehicle.

97. The antenna system of claim 95, wherein the satellite-signal antenna is configured to receive global positioning satellite (GPS) signals.

98. The antenna system of claim 95, wherein the satellite-signal antenna is integrated within an exterior rearview mirror housing.

* * * * *